US008210638B2

(12) United States Patent
Wada et al.

(10) Patent No.: US 8,210,638 B2
(45) Date of Patent: Jul. 3, 2012

(54) INK JET PRINTING APPARATUS AND INK JET PRITING METHOD

(75) Inventors: Satoshi Wada, Machida (JP); Hiromitsu Yamaguchi, Yokohama (JP); Makoto Akahira, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 172 days.

(21) Appl. No.: 12/024,628

(22) Filed: Feb. 1, 2008

(65) Prior Publication Data

US 2008/0252673 A1 Oct. 16, 2008

(30) Foreign Application Priority Data

Feb. 14, 2007 (JP) ..... 2007-033650

(51) Int. Cl.
*B41J 29/393* (2006.01)

(52) U.S. Cl. ..... 347/19; 347/5; 347/9; 347/12; 347/13; 347/14; 347/40; 347/42; 347/43; 347/49

(58) Field of Classification Search ..... None
See application file for complete search history.

(56) References Cited

U.S. PATENT DOCUMENTS 7,237,871 B2 7/2007 Yamaguchi et al.
7,278,700 B2 10/2007 Yamaguchi et al.
7,585,039 B2 9/2009 Ochiai et al.
2002/0171708 A1* 11/2002 Watanabe et al. ..... 347/40
2004/0095420 A1* 5/2004 Ikemoto et al. ..... 347/40
2004/0224102 A1* 11/2004 Ebihara ..... 428/32.1
2005/0062784 A1* 3/2005 Matsuzaki et al. ..... 347/19
2006/0214957 A1 9/2006 Wada
2006/0221110 A1* 10/2006 Kusakari ..... 347/15
2007/0165056 A1 7/2007 Yamaguchi et al.
2008/0049057 A1 2/2008 Ochiai et al.
2008/0136855 A1 6/2008 Ochiai et al.

* cited by examiner

*Primary Examiner* — Matthew Luu
*Assistant Examiner* — Justin Seo
(74) *Attorney, Agent, or Firm* — Fitzpatrick, Cella, Harper & Scinto

(57) ABSTRACT

An object of the present invention is to provide an ink jet printing apparatus which can prevent possible stripe-like density unevenness in a joint in a print head constructed by joining a plurality of chips together even if the print head is inclined to the regular position of the print head. The present invention uses a print head having the nozzle arrays being shifted in a direction in which the nozzles are arranged, so as to have overlapping portions in a direction orthogonal to the nozzle arranging direction. The present invention controls an ink ejecting operation of the nozzles in the overlapping portions between the plurality of nozzle arrays on the basis of an angle between the nozzle array arranging direction and a direction orthogonal to the direction in which the print head moves relative to the print medium.

8 Claims, 23 Drawing Sheets

| NOZZLE NO. | 1 | 2 | 3 | 4 | 5 | 6 | ••••••••• | n-5 | n-4 | n-3 | n-2 | n-1 | n |
|---|---|---|---|---|---|---|---|---|---|---|---|---|---|
| AREA A | 0 | 0 | 1 | 1 | 1 | 0 | ••••••••• | 1 | 0 | 1 | 1 | 0 | 0 |
| AREA B | 1 | 1 | 0 | 0 | 0 | 1 | ••••••••• | 0 | 0 | 1 | 0 | 0 | 0 |

FIG.8

INK JET PRINTING APPARATUS AND INK JET PRITING METHOD

BACKGROUND OF THE INVENTION

1. Field of the Invention

The present invention relates to an ink jet printing apparatus that prints an image on a print medium by ejecting ink onto the print medium through nozzles formed in a print head, and in particular, to a printing apparatus using a print head having a plurality of relatively short chips which are arranged to increase the length of the print head and in each of which nozzles are arranged.

2. Description of the Related Art

Advantageously, ink jet printing apparatuses generate only low noise during printing because the apparatuses cause ink droplets to land on a print medium for printing. The ink jet printing apparatus also requires only low running costs owing to its capability of printing ordinary paper and the like without any special process. Furthermore, with the ink jet printing apparatus, using a plurality of color inks enable color images to be relatively easily formed. Moreover, densely arranging nozzles advantageously allows high-resolution images to be formed at a high speed. In particular, what is called a full-line printing apparatus is suitable for increasing the speed of the image forming operation; the full-line printing apparatus uses a long print head having a large number of nozzles arranged in a direction orthogonal to a direction in which print media are conveyed. The full-line printing apparatus may thus be used as an on-demand printing apparatus, the need for which is increasing. Accordingly, the full-line printing apparatus is thus gathering much attention.

The on-demand printing is expected to save labor instead of printing as much as several million copies as in the conventional printing of newspapers or magazines or performing printing at a very high speed, for example, printing one hundred thousand copies per hour. The full-line printing apparatus offers a lower print speed than conventional printers for offset printing or the like but eliminates the need to make printing plates, making it possible to save labor. The full-line printing apparatus further allows a wide variety of print matter in small quantities to be printed in a short time. Thus, the full-line printing apparatus is optimum for on-demand printing.

The full-line printing apparatus used for the on-demand printing is desired to print large-sized print media at a high resolution and a high speed. For example, the full-line printing apparatus needs to print at least 30 A3-sized print media per minute at a resolution of at least 600×600 dpi for monochromatic documents containing texts or the like or at a resolution of at least 1,200×1,200 dpi for full color images such as photographs.

The full-line ink jet printing apparatus is not only desired to print such large-sized print media but may also be used to print images taken with a digital camera or the like on L-sized media as in the case of conventional silver halide photography or on small print media such as postcards.

The full-line ink jet printing apparatus thus has excellent functions of dealing with print media of plural sizes and performing printing at a high speed. Accordingly, the full-line ink jet printing apparatus is expected to be widely used not only for business use but also for domestic use.

However, for the full-line printing apparatus, it is very difficult to form nozzles made up of ejection orifices, ink paths, or ejection energy generating elements, over a wide range equal to or greater than the print width of large-sized print medium without causing any defect. For example, a printing apparatus providing photographic outputs to large-sized sheets such as materials used in offices or the like needs about 14,000 ejection orifices (print width: about 280 mm) in order to print A3-sized print sheets at a high density of 1,200 dpi. It is very difficult to provide ejection energy generating elements corresponding to such a large number of ejection orifices without causing any defect, in connection with a manufacturing process. Thus, even if such nozzles can be manufactured, efficiency percentage is low and enormous manufacturing costs are required.

Thus, the full-line printing apparatus also uses a print head H such as the one shown in FIG. 1. The print head H is what is called a joint head formed by arranging a plurality of relatively short, inexpensive chips CH such as those used in serial printing apparatuses so that the chips are sequentially joined together to form an elongate head as shown in FIGS. 1 and 2.

In the joint head H, the plurality of chips CH are arranged along one direction. The chips CH located adjacent to each other in the chip arranging direction are shifted in the chip arranging direction and in a direction orthogonal to the chip arranging direction. The chips CH located adjacent to each other in the chip arranging direction have an overlapping portion (a joint portion or an overlapping portion).

However, with the joint head H, a print image is likely to be degraded in portions thereof corresponding to joints b and c of the joint head H owing to the configuration thereof. Specifically, the image is degraded if the direction in which the nozzles in the joint head H, shown in FIGS. 1 and 2, are arranged is inclined at a certain angle θ to a direction S orthogonal to a direction in which the print head H performs a scan operation relative to a print medium (with a full line head, a direction in which the print medium is conveyed). That is, if the print head is inclined as shown in FIG. 3, nozzle intervals in the head denoted by A, B, and C have values expressed by Formulae 1, 2, and 3. In the formulae, R denotes an inter-nozzle distance in the chips, Y denotes an inter-joint-chip distance, and θ(°) denotes the inclination of the joint head H.

$$\text{Nozzle interval A: } R\times\mathrm{COS}(\theta) \quad \text{(Formula 1)}$$

$$\text{Nozzle interval B: } (R+Y\times\mathrm{TAN}(\theta))\times\mathrm{COS}(\theta) \quad \text{(Formula 2)}$$

$$\text{Nozzle interval C: } (R-Y\times\mathrm{TAN}(\theta))\times\mathrm{COS}(\theta) \quad \text{(Formula 3)}$$

Specifically, determination may be made, as described below, of by what amount the nozzle intervals A, B, and C deviate from an inter-nozzle distance R (the nozzle interval obtained when the print head is located along the reference direction S (the inclination is 0°) if the print head is located under conditions described below.

It is assumed that the nozzles in the head shown in FIGS. 1 and 2 have a density of 600 dpi, and inter-nozzle distance: R=42.3 μm, inter-chip distance: Y=10 mm (=10,000 μm), and head inclination: θ=0.05°. Then, the values of the nozzle intervals A, B, and C are determined in accordance with the formulae shown above. Then, the values obtained are compared with the inter-nozzle distance (R=42.3 μm).

Distance A: 42.29μ (almost no change)

Distance B: 51.03μ (an increase of 8.73 μm)

Distance C: 33.57μ (a decrease of 8.73 μm)

FIG. 19A shows a joint b including combinations (b1-b2) of nozzles having the nozzle interval B, shown in FIG. 3, and combinations (c1-c2) of nozzles having the nozzle interval C, shown in FIG. 3. As shown in FIG. 19A, in the joint b, four types of combinations (b1-b2) are possible for the nozzles having the nozzle interval B. Two types of combinations (c1-c2) are possible for the nozzles having the nozzle interval C. That is, in the joint b, the number of combinations (b1-b2) of the nozzles having the nozzle interval B is greater than that of combinations (c1-c2) of the nozzles having the nozzle interval C. Consequently, in the joint b, the number of areas printed by the nozzles having the nozzle interval B is larger than that of areas printed by the nozzles having the nozzle interval C.

FIG. 19B is a diagram showing an example of arrangement of dots printed by nozzles located in the joint b and the vicinity of the joint b when the print head H is tilted. In FIG. 19B, black circles denote dots printed by nozzles in a chip CH (N). White circles denote dots printed by nozzles in a CH(N−1). A method of printing dots corresponding to the joint b using the joint head H involves printing the dots so that the dots printed by the nozzles in the chip CH(N) alternate with the dots printed by the nozzles in the chip CH(N−1) array by array as shown in the figure.

In FIG. 19B, dots having a dot interval B' are printed by the nozzles having the nozzle interval B. The other dots are printed by nozzles in the same chip, that is, the nozzles having the nozzle interval A. The nozzle interval A is almost equal to the nozzle interval R, corresponding to the non-tilted print head. Thus, the dots printed by the nozzles having the nozzle interval A are uniformly arranged. However, since the nozzle interval B is greater than the nozzle interval R, a blank is formed between the dots printed by the nozzles having the nozzle interval B, that is, the dots having the dot interval B'. This causes the vicinity of the joint b to be perceived as a white stripe.

FIG. 19C is a diagram showing another example of arrangement of the dots printed using the nozzles arranged in the joint b and the vicinity of the joint b. The method of printing the dots corresponding to the joint b differs between FIGS. 19B and 19C. In FIG. 19C, in the joint b, the dots printed by the nozzles in the chip CH(N) are staggered with respect to the dots printed by the nozzles in the chip CH(N−1).

In FIG. 19C, dots having a dot interval B' are printed by the nozzles having the nozzle interval B. Dots having a dot interval C' are printed by the nozzles having the nozzle interval C. The other dots are printed by nozzles in the same chip, that is, the nozzles having the nozzle interval A. In FIG. 19C, some of the dots are printed by the nozzles having the nozzle interval C, which is smaller than the nozzle interval R, corresponding to the non-tilted print head. However, as shown in FIG. 19A, in the joint b, the number of combinations (b1-b2) of the nozzles having the nozzle interval B is larger than that of combinations of the nozzles having the nozzle interval C. Consequently, in the joint b, the number of dots having the dot interval B' is larger than that of dots having a dot interval C'. An area printed by the nozzles located in the joint b and the vicinity of the joint b is thus perceived as a white stripe.

FIG. 20A shows a joint c including combinations (b1-b2) of the nozzles having the nozzle interval B, shown in FIG. 3, and combinations (c1-c2) of the nozzles having the nozzle interval C, shown in FIG. 3. As shown in FIG. 20A, in the joint c, two types of combinations (b1-b2) are possible for the nozzles having the nozzle interval B. Four types of combinations (c1-c2) are possible for the nozzles having the nozzle interval C. That is, in the joint c, the number of combinations (c1-c2) of the nozzles having the nozzle interval C is larger than that of combinations (b1-b2) of the nozzles having the nozzle interval B. Consequently, in the joint c, the number of areas printed by the nozzles having the nozzle interval C is greater than that of areas printed by the nozzles having the nozzle interval B.

FIGS. 20B and 20C show the arrangement of dots printed by nozzles located in the vicinity of the joint c and the vicinity of the joint c when the print head H is tilted. Black circles denote dots printed by nozzles in a chip CH (N). White circles denote dots printed by nozzles in a CH(N+1). A method of printing dots corresponding to the joint c as shown in FIGS. 20B and 20C is the same as the method of printing dots corresponding to the joint b as shown in FIGS. 19B and 19C.

In FIG. 20B, dots overlap each other which are printed by the nozzles having the nozzle interval B, which is smaller than the nozzle interval R, corresponding to the non-tilted print head H. An area printed by the nozzles located in the joint c and the vicinity of the joint c is thus perceived as a black stripe.

In FIG. 20C, some of the dots are printed by the nozzles having the nozzle interval B, which is larger than the nozzle interval R, corresponding to the non-tilted print head. However, as shown in FIG. 20A, in the joint c, the number of combinations (c1-c2) of the nozzles having the nozzle interval C is larger than that of combinations of the nozzles having the nozzle interval B. Consequently, an area printed by nozzles located in the joint c and the vicinity of the joint c, the number of dots having the dot interval C' is larger than that of dots having the dot interval B'. The area printed by nozzles located in the joint c and the vicinity of the joint c is thus perceived as a black stripe. As described above, tilted joint head may result in a white or black stripe in the area printed by joints of the print head, degrading the quality of recorded images.

SUMMARY OF THE INVENTION

An object of the present invention is to provide an ink jet printing apparatus and an ink jet printing method which can prevent possible stripe-like density unevenness in a joint in a print head constructed by joining a plurality of chips together even if the print head is inclined to the regular position of the print head.

To achieve this object, the present invention is configured as described below.

A first aspect of the present invention is an ink jet printing apparatus performing printing by moving a print head having a plurality of nozzle arrays each including a plurality of the nozzles through which ink is ejected, relative to a print medium while ejecting ink to the print medium through the nozzles, the nozzle arrays being shifted in a direction in which the nozzles are arranged, so as to have overlapping portions in a direction orthogonal to the nozzle arranging direction, the apparatus comprising: a controller that controls an ink ejecting operation of the nozzles in the overlapping portions on the basis of an angle between a direction in which the plurality of nozzle arrays are arranged and a reference direction orthogonal to the direction in which the print head moves relative to the print medium.

A second aspect of the present invention is an ink jet printing apparatus performing printing by moving a print head having a plurality of nozzle arrays each including a plurality of the nozzles through which ink is ejected, relative to a print medium while ejecting ink to the print medium through the nozzles, the nozzle arrays being shifted in a direction in which the nozzles are arranged, so that positions of ends of the nozzle arrays adjacent to each other in the nozzle arranging direction are equal in the nozzle arranging direction, the apparatus comprising: a controller that controls an ink ejecting operation of nozzles located at ends of the plurality of nozzle arrays on the basis of an angle between a direction orthogonal to the moving direction of the print head relative to the print medium and a direction in which the plurality of nozzle arrays are arranged.

A third aspect of the present invention is an ink jet printing method of performing printing by moving a print head having a plurality of nozzle arrays each including a plurality of the nozzles through which ink is ejected, relative to a print medium while ejecting ink to the print medium through the nozzles, the nozzle arrays being shifted in a direction in which the nozzles are arranged, so as to have overlapping portions in a direction orthogonal to the nozzle arranging direction, the method comprising: a measuring step of measuring an angle between a direction orthogonal to the direction in which the print head moves relative to the print medium and a direction in which the plurality of nozzle arrays are arranged; and a control step of controlling an ink ejecting operation of the nozzles in the overlapping portions on the basis of the angle measured in the measuring step.

The term "print" as used herein refers not only to formation of significant information such as letters or graphics but also to formation of images, patterns, or the like on a printed material or processing of a print medium, in a broad sense, regardless of whether or not the image is significant and whether or not the image is actualized so as to be visually perceived by human beings.

The term "print medium" refers not only to paper used for common ink jet printing apparatuses but also to clothes, plastic films, metal plates, or the like, that is, anything that can receive ink ejected by a head, in a broad sense.

The term "ink" should be broadly interpreted as in the case of the definition of the term "print" and refers to a liquid applied onto a printed material and used to form images, patterns, or the like or to process a printed material.

Even if the print head is inclined to the appropriate position thereof, the present invention can prevent possible stripe-like density unevenness that may occur at a joint between chips. This enables high image quality to be achieved even with what is called a joint head.

Further features of the present invention will become apparent from the following description of exemplary embodiments (with reference to the attached drawings).

BRIEF DESCRIPTION OF THE DRAWINGS

FIG. 8 is a diagram showing 2-bit selection data allowing the selection of a driving pulse (double pulse) corresponding to each of the nozzles in the print head;

DESCRIPTION OF THE EMBODIMENTS

Embodiments of the present invention will be described below in detail with reference to the drawings.

(First Embodiment)

Figure 4:
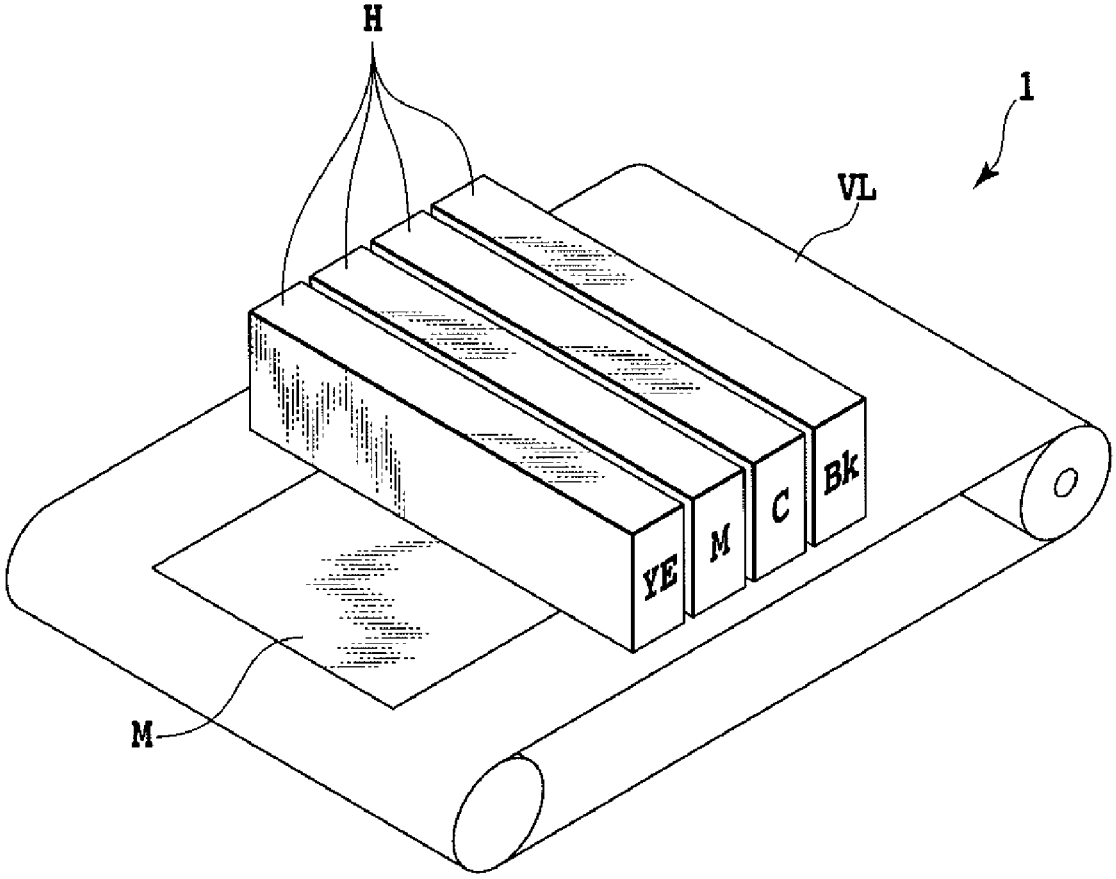
FIG. 4 is a perspective view conceptually showing an ink jet printing apparatus to which the present invention is applicable.

FIG. 4 is a perspective view schematically showing a full line ink jet printing apparatus (hereinafter simply referred to as a printing apparatus) in accordance with an embodiment of the present invention.

Figure 1:
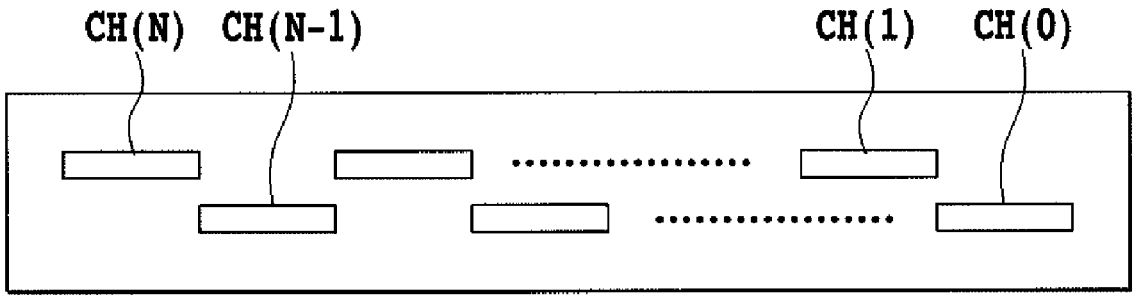
FIG. 1 is a diagram schematically showing a print head (joint head) used in an embodiment of the present invention.
Figure 2:
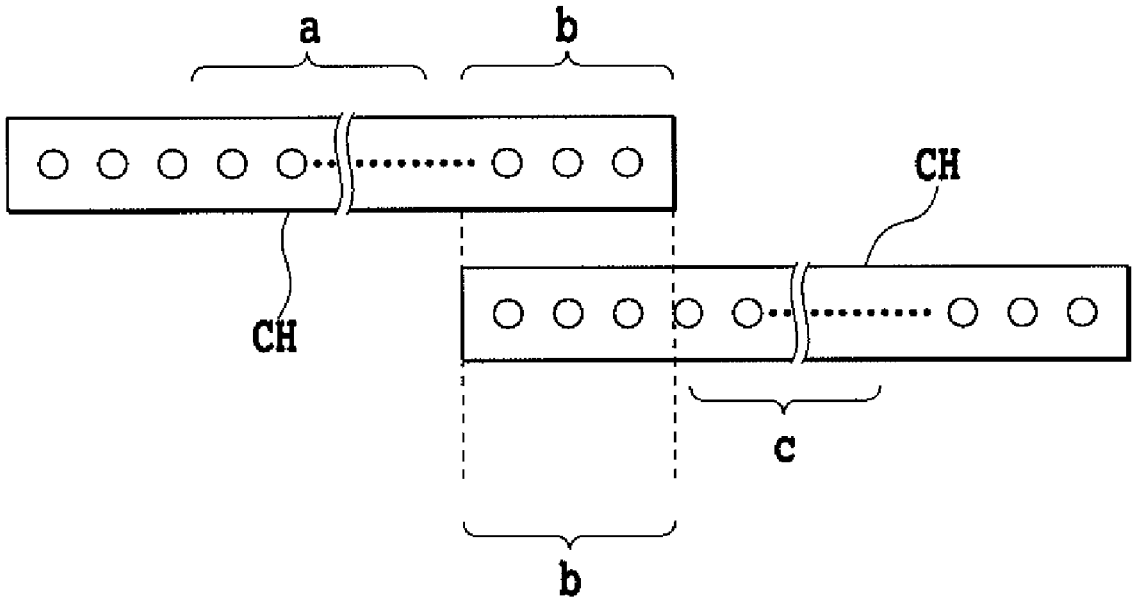
FIG. 2 is an enlarged view schematically showing how chips are joined together in a print head used in a first embodiment of the present invention.

An ink jet printing apparatus 1 shown in FIG. 4 is what is called a full line type having elongate print heads (hereinafter referred to as "joint heads") for respective ink colors each of which is constructed by joining a plurality of chips such as those shown in FIG. 1. In FIG. 4 shows that four print heads H eject four color inks, yellow (YE) ink, magenta (M) ink, cyan (C) ink, and black (Bk) ink, respectively, to form an image. However, the present invention is not limited to the types of the inks used, the number of print heads, and the like shown in FIG. 4. These factors can be optionally set and the present invention is effective in any case.

The full-line printing apparatus performs a printing operation by conveying a print medium along a direction substantially orthogonal to the longitudinal direction of the print heads H. Each of the print heads H has a print width equal to or greater than the width of the maximum available print medium. Furthermore, the print medium M is conveyed by cyclically moving an endless conveying belt VL by means of a motor (not shown) in accordance with the present invention. An image is formed on the print medium by ejecting ink droplets from the print heads H in accordance with print data while moving the conveying belt VL to continuously convey the print medium M placed on a top surface of the conveying belt VL.

Now, with reference to FIG. 5, a brief description will be given of the internal structure of the print head applied to the present embodiment.

Figure 5:
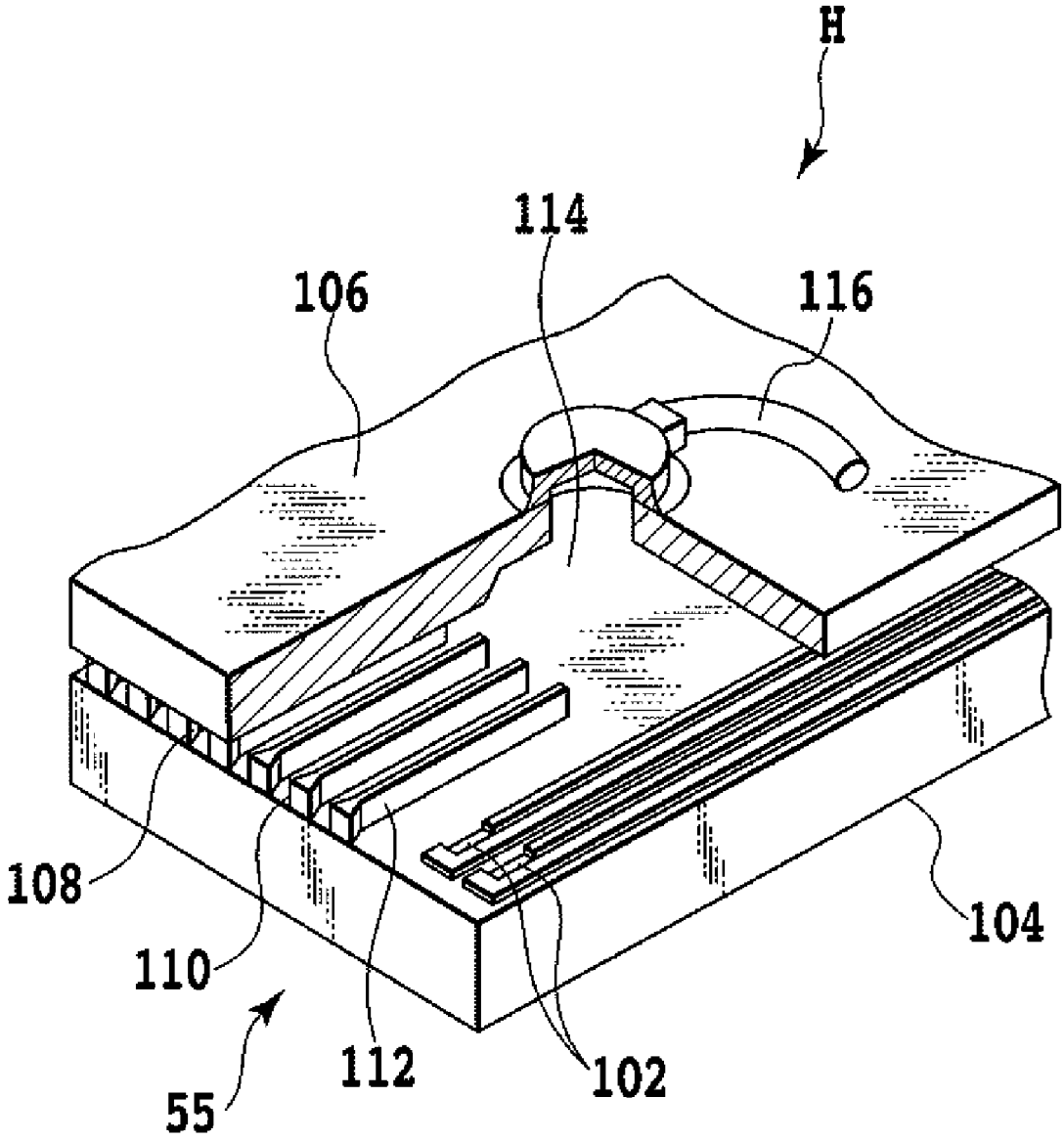
FIG. 5 is a partly cutaway perspective view showing the internal configuration of a print head using electrothermal conversion elements as ejection energy generating elements for ink droplets.

The print head H shown in FIG. 5 is an ink jet print head in which ink is rapidly heated by an electrothermal conversion element (heater) to generate bubbles so that the pressure of the bubbles causes ink droplets to be ejected from ejection orifices.

The print head H comprises a heater board 104 that is a board on which a plurality of heaters 102 that heat ink and a top panel 106 placed on the heater board 104. A plurality of ejection orifices 108 are formed in the top panel 106. Tunnel-like liquid path liquid paths 110 are formed behind the respective ejection orifices 108 so as to be in communication with the ejection orifices 108. Each of the liquid paths 110 is isolated from the adjacent liquid paths by bulkheads 112. All the liquid paths 110 are connected to one ink liquid chamber 114 located behind the liquid paths 110. Ink is supplied to the ink liquid chamber 114 via an ink supply port 116. The ink is fed from the ink liquid chamber 114 to the respective liquid paths 110.

The heater board 104 and the top panel 106 are aligned and assembled together so that the heaters 102 are positioned in association with the respective liquid paths 110. FIG. 5 shows only two heaters 102. However, in actuality, the heaters 102 and the liquid paths 110 are provided on a one-to-one basis. The heater board 104 is manufactured by a semiconductor process using a silicon substrate as a base. Signal lines that drive the heaters 102 are connected to a driving circuit formed on the same board. Supplying a predetermined driving pulse to the heaters 102 causes the ink on the heaters 102 to be boiled to form bubbles. The bubbles expand to increase the volume thereof to eject the ink from the ejection orifices 108. This is the principle of ink ejection in the ink jet print head using the electrothermal conversion elements. In the present specification and claims, an ink ejecting section (nozzles) means a part including the ejection orifices 108, the liquid paths 110, and the heaters 102.

Figure 6:
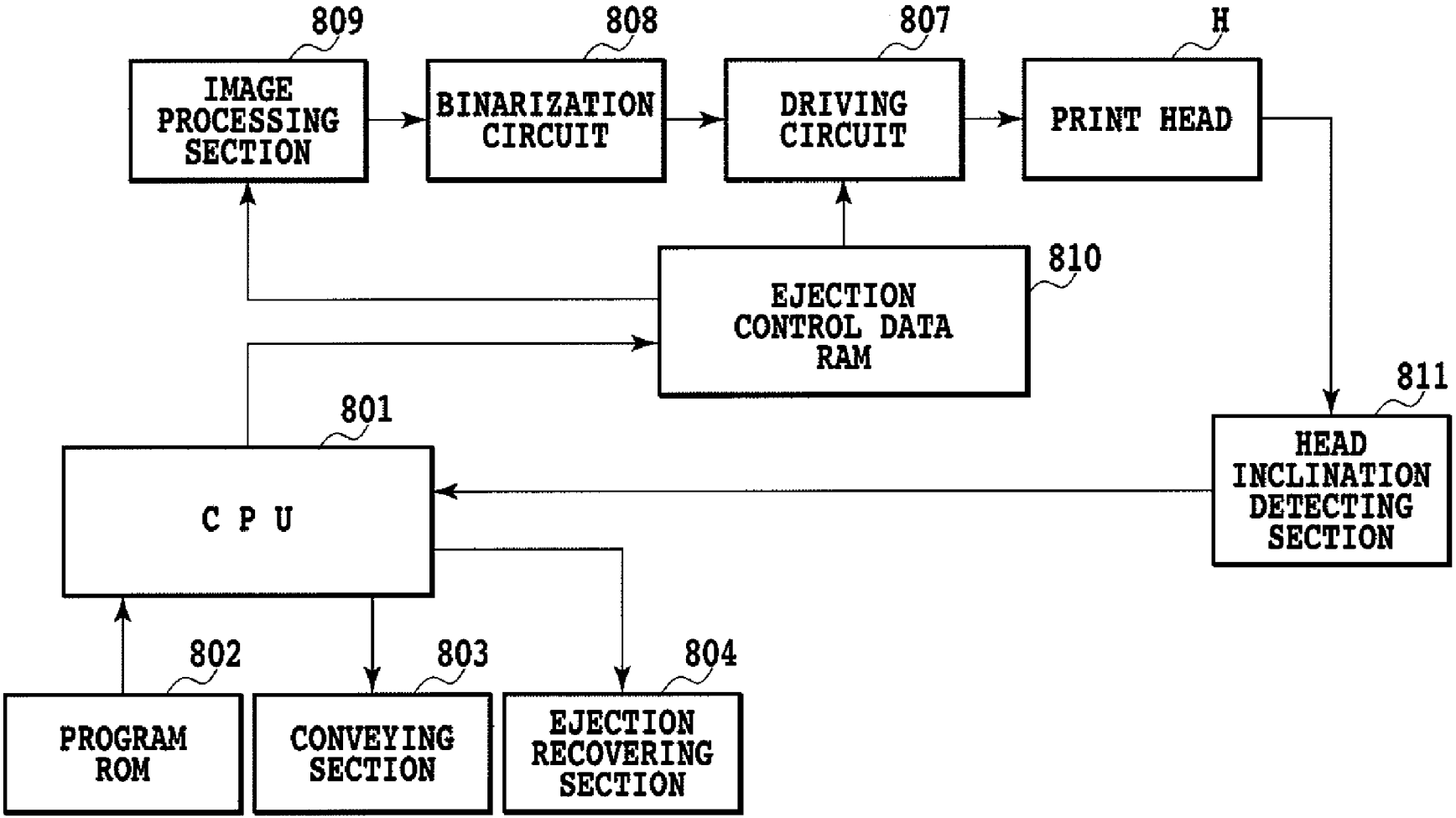
FIG. 6 is a block diagram showing the circuit configuration of a control system in the embodiment of the present invention.

FIG. 6 is a block diagram showing the general configuration of a control system in the ink jet printing apparatus in which the embodiment of the present invention is mounted.

In FIG. 6, reference numeral 801 denotes a CPU that executes various calculations, determinations, and control processes. The CPU 801 controls the whole printing apparatus in accordance with software programs and the like stored in a ROM 802. Reference numeral 803 denotes a conveying section that conveys print media such as print sheets or OHP films and that corresponds to the conveying belt and a motor driving the conveying belt. Reference numeral 804 denotes an ejection recovery section that performs an operation of recovering the ejection performance of the print head. Reference numeral 807 denotes a driving circuit that controls ejections from the print head. Reference 808 denotes a binarization circuit that converts an image to be printed into ejection data and that executes a halftone process and the like on image data. Reference numeral 809 denotes an image processing section that executes image processing such that in this case, if the image to be printed is a color image, input image data is separated into ink colors used for the printing apparatus. Reference numeral 810 denotes a RAM that stores data required to control ejections as described below. The RAM 809, the CPU 801, the ROM 802, and the driving circuit 806 constitute control means in accordance with the present invention.

Reference numeral 811 denotes a head inclination detecting section (detecting means) that detects the inclination of the print head H, that is, the inclination (angle) of a direction in which the print head H performs a scan operation relative to a print medium (with a full line head, a direction in which the print medium is conveyed), to the reference direction, which is orthogonal to the print medium conveying direction. The detecting means is composed of an optical sensor such as a CCD which optically reads an inclination detecting pattern printed on the print medium as described below. Data obtained by reading the inclination detecting pattern is sent to the CPU 801. The CPU 801 determines the inclination of the print head on the basis of the data read by the head inclination detecting section 811 and reads data required for ejection control from the RAM as required. The head inclination detecting section 811 and the CPU 801 constitute measuring means in accordance with the present invention.

Now, on the basis of the above-described configuration, description will be given of the ink ejection control performed by the ink jet printing apparatus in accordance with the present embodiment.

In the present embodiment, before starting the use of the ink jet printing apparatus, the print head H is used to print a pattern (measuring pattern) required to measure the inclination of the print head H, on the print medium. The inclination of the print head H is then measured on the basis of the pattern.

Figure 17:
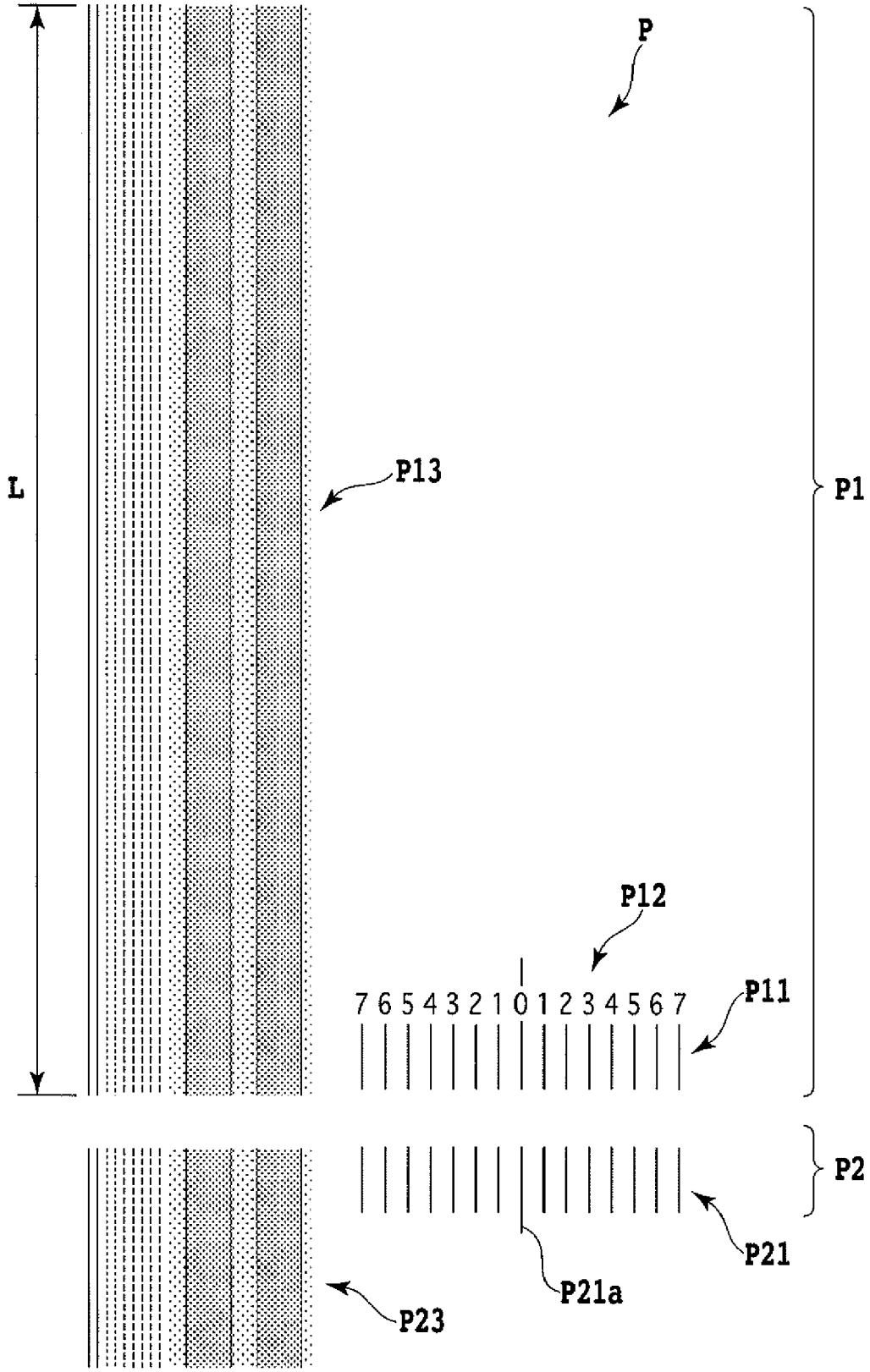
FIG. 17 is a diagram showing a pattern used for measurement of the inclination of the print head in the embodiment of the present invention.
Figure 18:
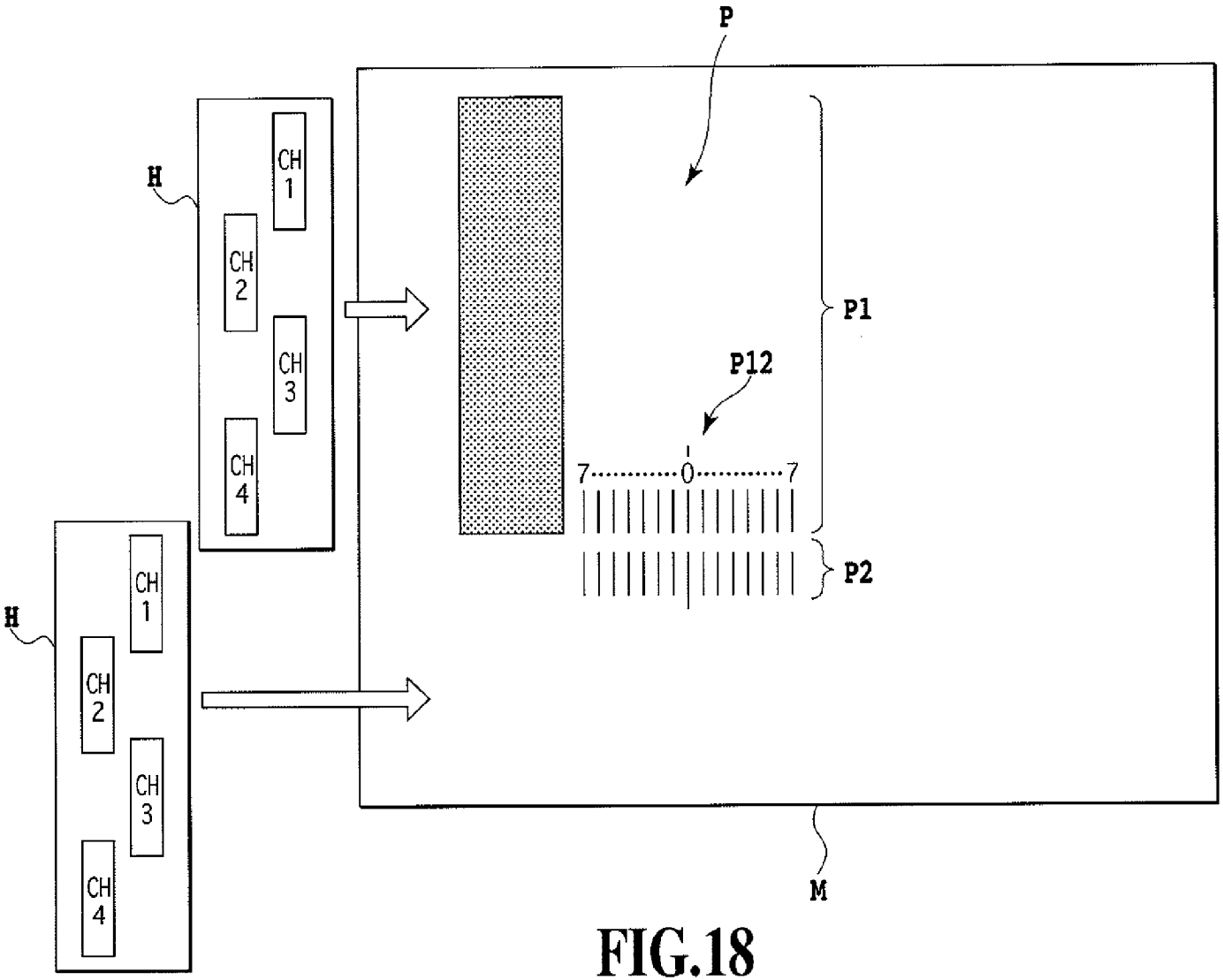
FIG. 18 is a diagram showing a pattern forming method used for measurement of the inclination of the print head in the embodiment of the present invention.
Figure 19A:
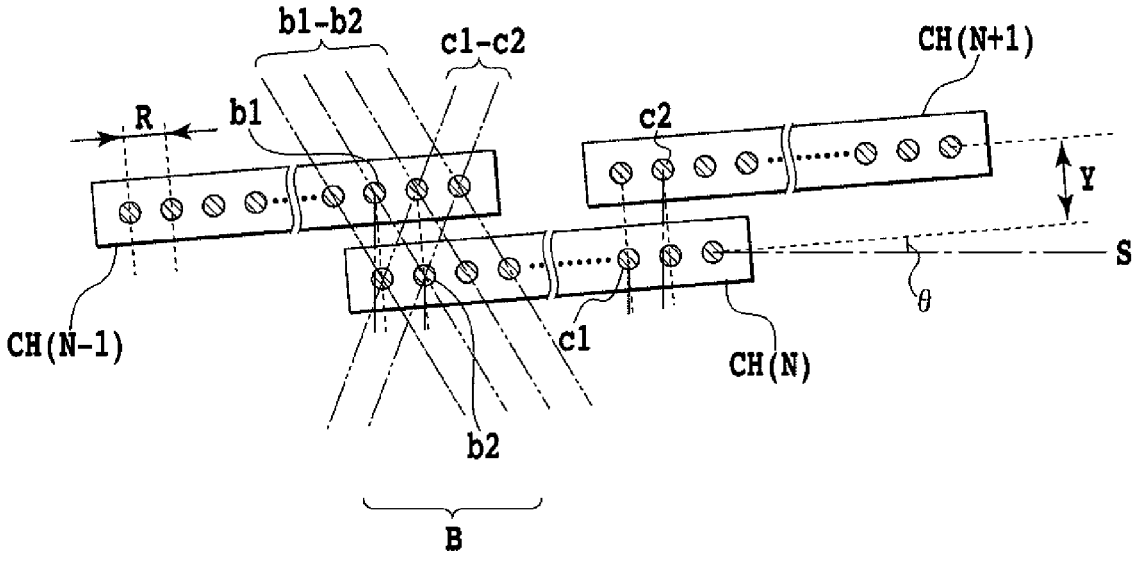
FIG. 19A is a diagram showing a joint b including combinations of nozzles having a nozzle interval B shown in FIG. 3 and combinations of nozzles having a nozzle interval C shown in FIG. 3.
Figure 19B:
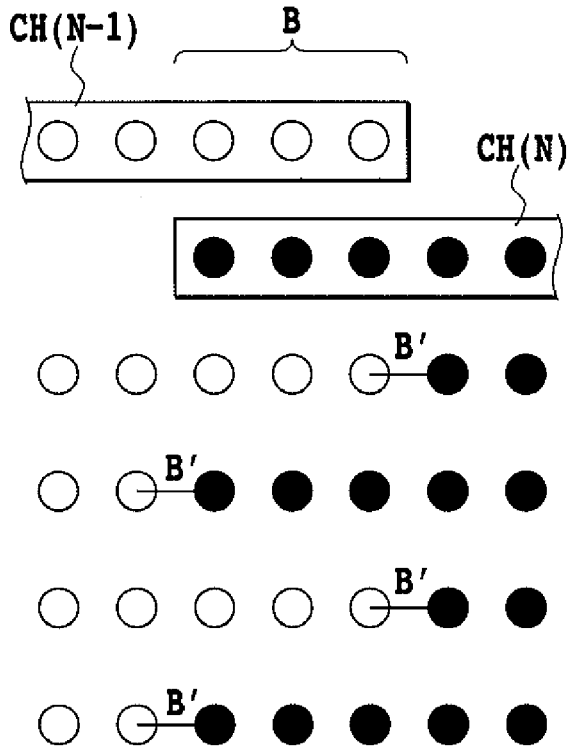
FIG. 19B is a diagram showing an example of arrangement of dots printed by nozzles arranged in the joint b and the vicinity of the joint b when a print head H is tilted.
Figure 19C:
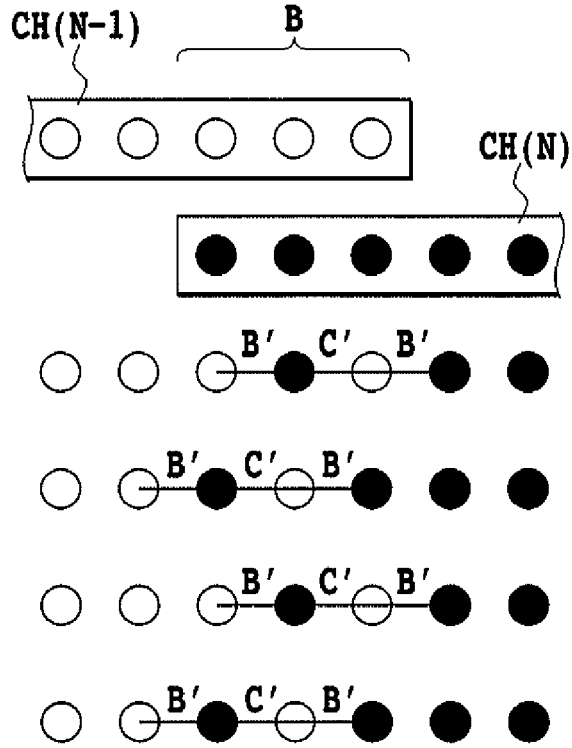
FIG. 19C is a diagram showing another example of arrangement of dots printed using the nozzles arranged in the joint b and the vicinity of the joint b.
Figure 20A:
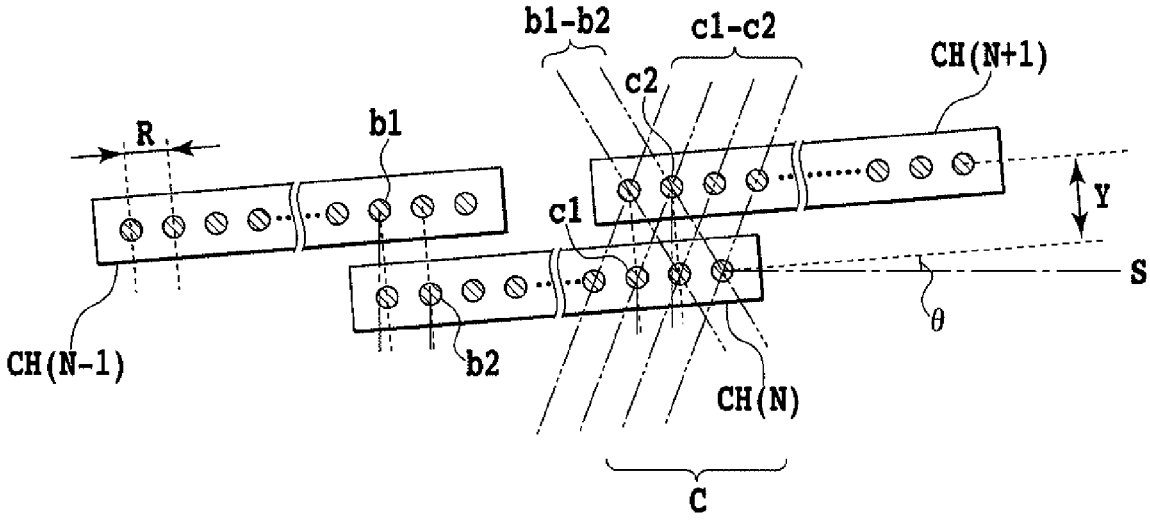
FIG. 20A is a diagram showing a joint c including combinations of the nozzles having the nozzle interval B, shown in FIG. 3, and combinations of the nozzles having the nozzle interval C, shown in FIG. 3.
Figure 20B:
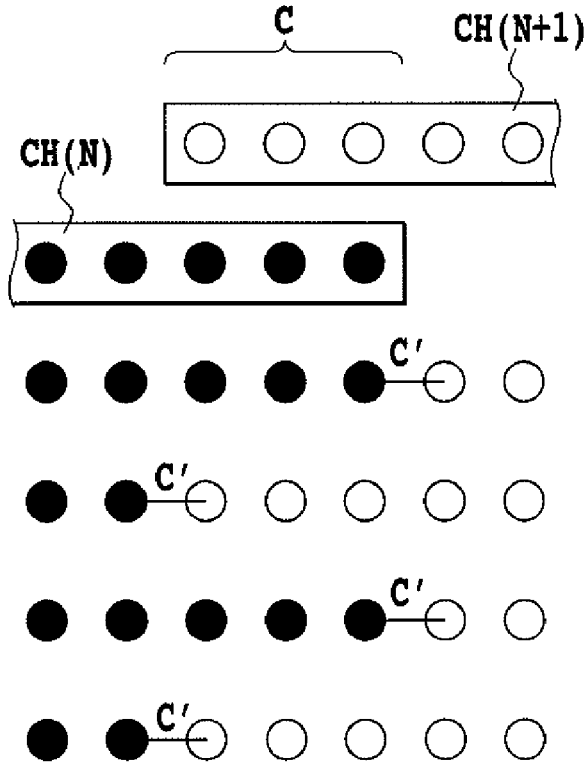
FIGS. 20B and 20C are diagrams showing the arrangement of dots printed by the nozzles arranged in the joint c and the vicinity of the joint c when the print head H is tilted, wherein black circles show dots printed by nozzles in a chip CH (N) and white circles show dots printed by nozzles in a chip CH(N+1)
Figure 20C:
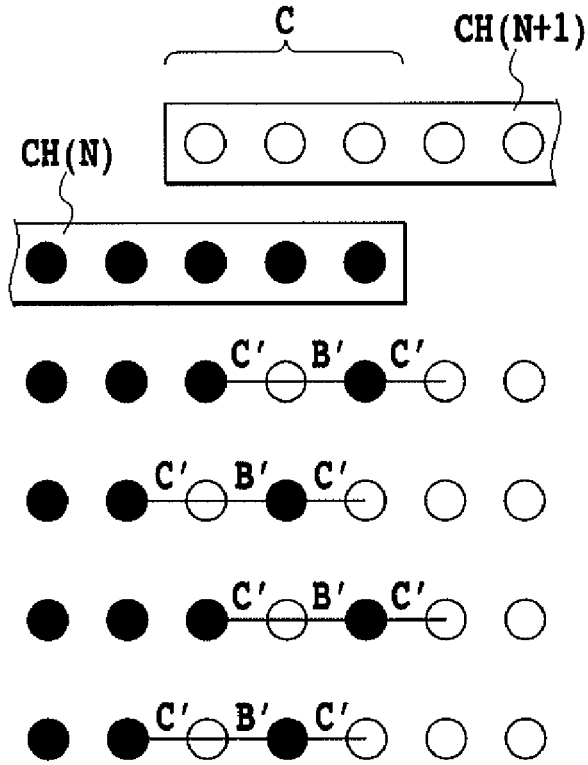

FIG. 17 shows an example of the measuring pattern required to measure the degree (angle) of the inclination of the print head H. FIG. 18 shows a method for printing the measuring pattern P. As shown in FIGS. 17 and 18, the measuring pattern P is divided into two patterns, an upper pattern P1 and a lower pattern P2. The two patterns P1 and P2 are printed on the print medium M in two separate steps, using the print medium H constructed by joining the four short chips CH1 to CH4 together. That is, first, the upper pattern P1 in FIG. 17 is printed, and then the print head H or the print medium M is relatively shifted in the vertical direction. The pattern P2 is then printed.

The pattern P1, printed in the first printing operation, includes a plurality of (in the figure, 15) linear patterns (lines)

P11 extending in the vertical direction, numbers P12 printed above the respective lines P11, and a pattern P13 used to check how each of the nozzles in the print head ejects ink. The numbered lines P11 are formed at fixed intervals (in this case, an integral multiple of printing resolution). The numbered linear patterns P11 are printed by the chip CH4, one of the four chips of the print head H which is located at the lowermost end in the figure.

On the other hand, the pattern P2, printed in the second printing operation, includes a plurality of (15) linear patterns P21 extending in the vertical direction and printed at fixed intervals, similarly to the linear patterns P11, printed in the first printing operation. A pattern P23 is also printed to allow ejection performance to be checked. In this case, the pattern P2 is printed by the chip CH1, one of the four chips of the print head H which is located at the uppermost end in the figure.

The inclination of the print head can be measured on the basis of the pattern P printed as described above. That is, if the inclination of the print head is zero, the 0th line (line no. 0) in the upper lines P11 overlaps the 0th line (the line positioned in the center (and longer than the other lines)) P21*a* in the lower lines P21. However, if the print head H is inclined, the lower center line P21*a* shifts from the upper 0th line and overlaps another line, depending on the inclination. On the basis of the amount of shift of the lower line P21*a* from the 0th line and the total length (L) of the upper pattern P1, the inclination of the print head H can be determined in accordance with the following formula. That is, on the basis of the shift amount and the total length of the upper pattern, the inclination (θ) of the head can be determined in accordance with the following formula.

$$\sin(\theta)=(\text{shift amount})/(\text{total length of the upper pattern } P1)$$

Figure 3:
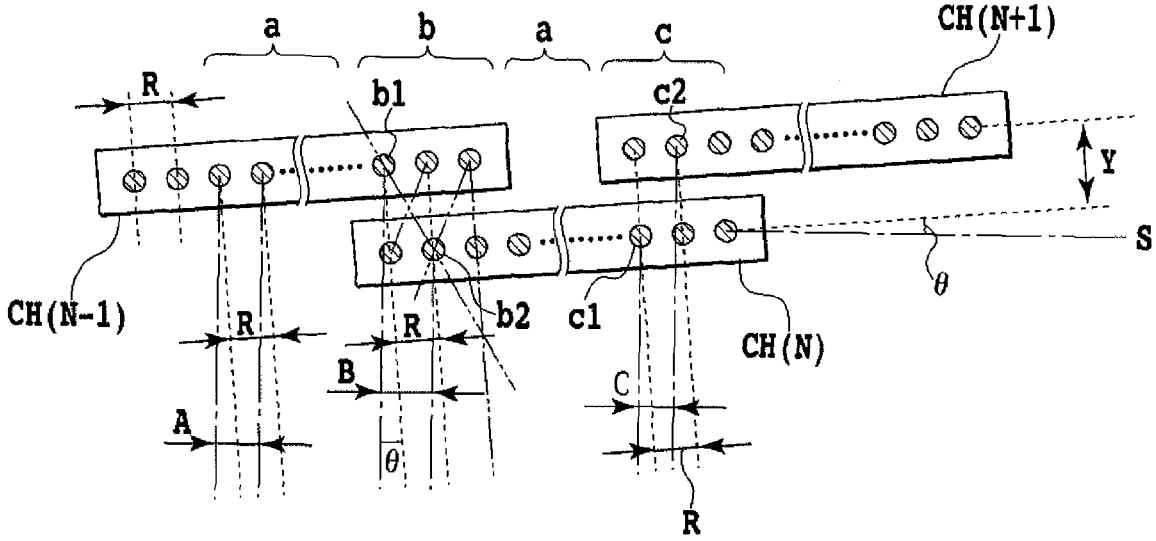
FIG. 3 is a diagram showing that the print head shown in FIG. 2 is inclined as well as the resulting intervals between adjacent nozzles in joints.

Whether the shift amount is present on the right or left side of the 0th line determines the direction of the inclination of the whole print head H. If the inclining direction is reversed, the ejection control method executed on the joints band c between the chips needs to be exactly reversed. For example, as shown in FIG. 3, if the print head is located so as to be high on the right with respect to the appropriate arranging direction, in the joint b, the number of combinations of nozzles having an increased adjacent nozzle interval increases, whereas in the joint c, the number of combinations of nozzles having a reduced adjacent nozzle interval increases. That is, white stripes are likely to occur at the joint b, whereas black stripes are likely to occur at the joint c. In contrast, if the print head is located so as to be low on the right with respect to the appropriate arranging direction, in the joint b, the number of combinations of nozzles having a reduce nozzle interval between the adjacent nozzles increases, whereas in the joint c, the number of combinations of nozzles having an increased adjacent nozzle interval increases. That is, black stripes are likely to occur at the joint b, whereas white stripes are likely to occur at the joint c.

Thus, whether white or black stripes occur depends on the degree of the inclination of the print head H. Consequently, the present embodiment controls the ejecting operation of the nozzles in the joint on the basis of the angle θ of the inclination of the print head H and the direction of the inclination of the print head H.

A specific description will be given of the control of the ejecting operation of the print head performed in accordance with the present embodiment.

To prevent possible white and black stripes in a print area corresponding to the nozzles in the joint, the present embodiment controls the ink amount of ejected ink droplets. The ink amount of ejected ink droplets is controlled by varying the application voltage or time of a driving signal supplied to the driving circuit 807.

As already described, the print head H rapidly heats ink by the heaters 102 to generate bubbles in the ink. The bubbles expand to increase the volume thereof to push the ink from the ejection orifices. Thus, the size of the bubbles can be adjusted by controlling a driving pulse applied to the heaters 102. This in turn makes it possible to control the amount of ink ejected during a single ink ejecting operation, that is, the ink amount of ink droplets (hereinafter also referred to as the ejection amount).

Figure 7A:
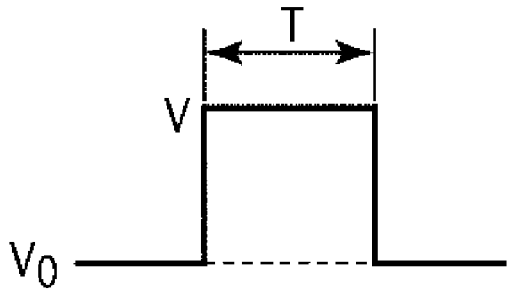
FIG. 7A is a diagram showing a driving pulse used to drive electrothermal conversion elements in a print head, and specifically, showing a single pulse.
Figure 7B:
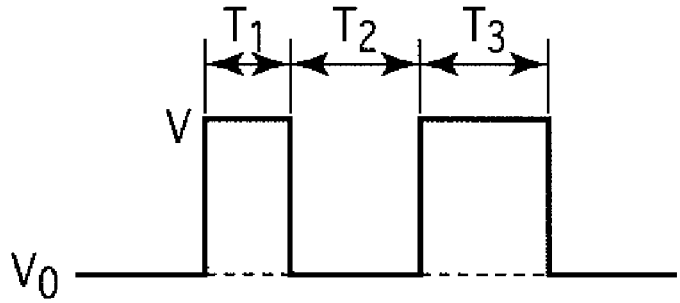
FIG. 7B is a diagram showing a driving pulse used to drive the electrothermal conversion elements in the print head, and specifically, showing a double pulse.

FIGS. 7A and 7B illustrate a driving pulse for the heaters. FIG. 7A shows the pulse waveform of single pulse driving. FIG. 7B shows the pulse waveform of double pulse driving. With the single pulse driving in FIG. 7A, the ink amount of ink droplets can be controlled by varying pulse width T instead of a voltage (V-V0). Furthermore, in connection with the control range of the ejection amount, the double pulse driving in FIG. 7B allows the ejection amount to be adjusted over a wider range than the single pulse driving and is thus a more effective control scheme. That is, most of the heat generated by the heaters is absorbed by the ink contacting the surface of the heaters. Accordingly, application of a pre-pulse enables the ink itself to be sufficiently heated to help the subsequent ejection of ink droplets caused by the main pulse. Thus, the double pulse driving allows the ejection amount to be controlled more efficiently than the single pulse driving.

In FIGS. 7A and 7B, when T1, T2, and T3 denote pre-pulse width, halt period, and main pulse width, respectively, and the main pulse width T3 is fixed, varying the pre-pulse width T1 enables the ejection amount of the nozzles in each of the joints in the print head H. That is, increasing T1 increases the ejection amount, whereas reducing T1 reduces the ejection amount.

Now, an example of the double pulse driving will be shown in which the ejection amount is controlled by assigning the different pre-pulses T1 to the respective nozzles.

As shown in FIG. 8, 2-bit data corresponding to the nozzles is written in RAM areas A and B (corresponding to the ejection control data RAM 810). Specifying the 2-bit data enables selection from pulses PH1 to PH4 of respective pulse widths shown in FIGS. 9A to 9D.

For example, if bit data input to nozzles b1 and b2 (see FIG. 3) corresponding to a joint is (0, 1), the pulse PH2 is selected. If bit data input to nozzles c1 and c2 (see FIG. 3) is (1, 0), the pulse PH3 is selected.

Figure 9A:
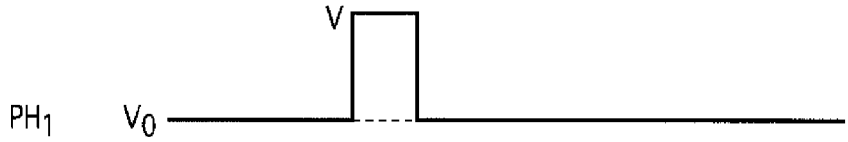
FIGS. 9A to 9I are waveform diagrams showing pre-pulses and a main pulse selected in accordance with the selection data and synthesis waveforms of double pulses obtained by synthesizing the pre-pulses and the main pulse.
Figure 9B:
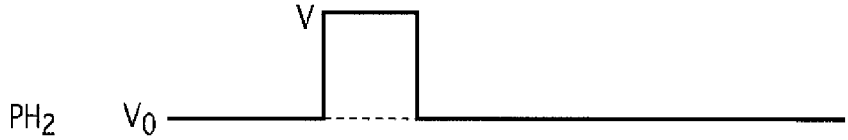
Figure 9C:
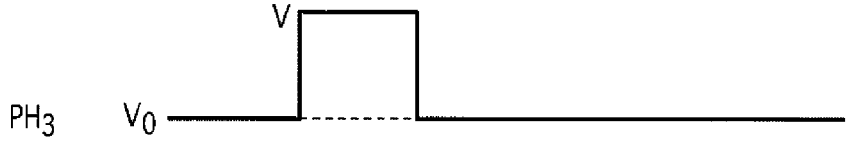
Figure 9D:
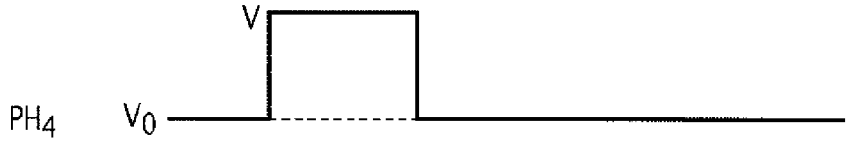
Figure 9E:
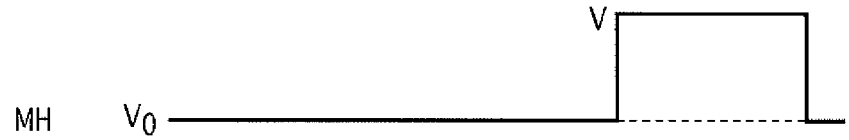
Figure 9F:
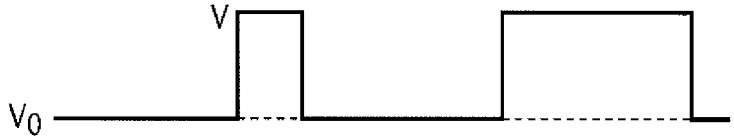
Figure 9G:
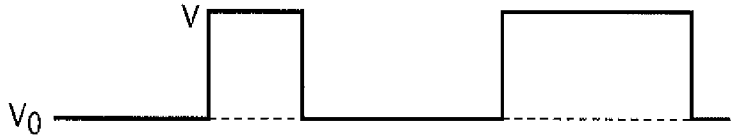
Figure 9H:
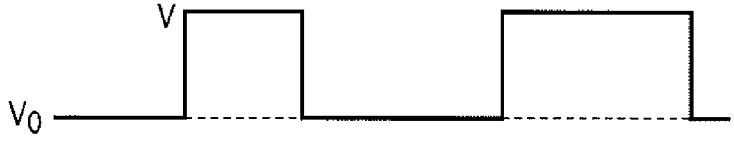
Figure 9I:
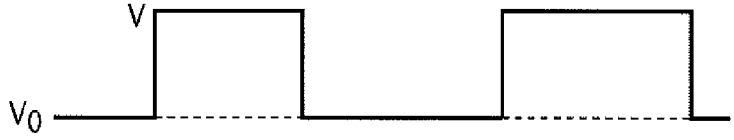

Thus, assigning bit data for pre-pulse selection to the respective nozzles enables the ejection amount of each nozzle to be varied. After the pre-pulse is applied to the heaters, a main pulse MH shown in FIG. 9E is applied.

Figure 10:
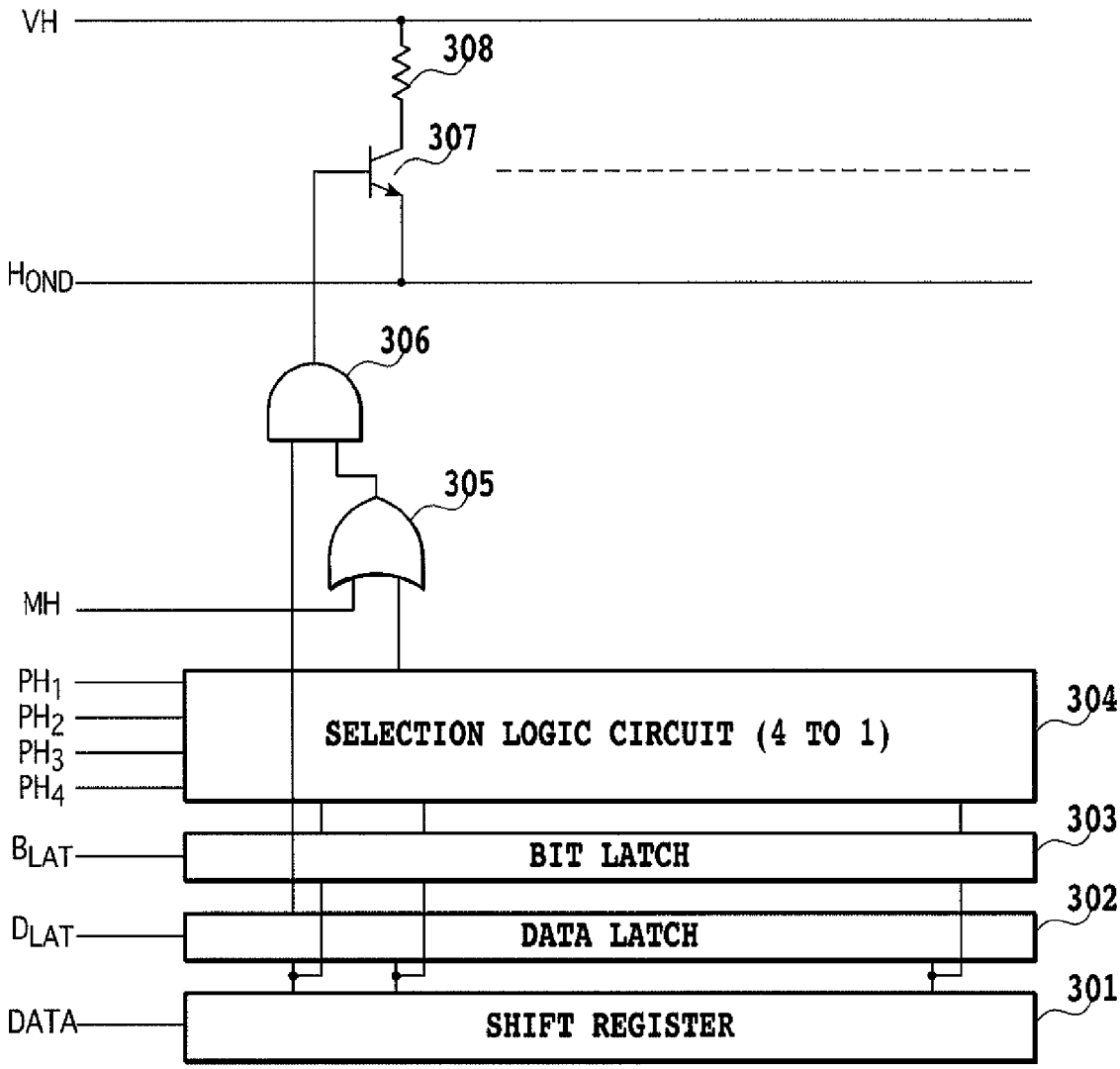
FIG. 10 is a circuit diagram showing a part of the configuration of a driving circuit for the print head used in the first embodiment of the present invention.

FIG. 10 shows the configuration of a driving circuit for the heaters.

In FIG. 10, reference character VH denotes a power voltage for the ink jet head, and reference numeral $H_{GND}$ denotes ground for VH. Reference character MH denotes the main pulse, and reference characters PH1 to PH4 denote the pre-pulses. Reference character $B_{LAT}$ denotes a bit latch signal instructing the bit data (selection bit data) for selection from PH1 to PH4 to be latched. DLAT denotes a data latch signal that causes data (print data) required for printing to be latched. Reference character DATA denotes bit data and print data transferred to a shift register as serial data.

In the driving circuit configured as described above, the bit data shown in FIG. 8 is transferred through a DATA signal line to a shift register 301 as serial data. Once the bit data on all the nozzles is transferred to the shift register 301, a bit latch signal $B_{LAT}$ is generated to latch the bit data.

The print data DATA, required for printing, is then transferred to the shift register 301 through the DATA signal line, similarly to the bit data (selection bit data). Once the print data for all the nozzles is transferred, the data latch signal $D_{LAT}$ is generated to cause a data latch circuit 302 to latch print data. Then, on the basis of the bit data already latched by the bit latch circuit 303, a selection logic circuit 304 selects one of PH1 to PH4. The selected one of the pre-pulses PH1 to PH4 and the main pulse MH are synthesized by an OR circuit 305. The logical AND of an output from the OR circuit 305 and the print data is then output by an AND circuit 306 as a driving signal (electric signal). The driving signal is input to a base of a transistor 307 for each of the nozzles. If the driving signal input to the base of the transistor 307 is an ON signal, the transistor is turned on. The power voltage VH allows current to flow through a resistor 308 (corresponding to the heater), which thus generates heat. The heat generates bubbles in the ink in the nozzle to eject the ink. This operation is performed on all the nozzles.

FIGS. 9F to 9I show the waveforms of synthetic signals of the heat pulse signal PH and the main pulse signal MH output by the OR circuit 305. As shown in the figures, the synthetic signals are obtained by synthesizing the fixed main pulse MH with the pulse signals of different pulse widths. To change the ink ejection amount, the bit data DATA corresponding to the required ejection amount is sent to the shift register 301, and the bit latch signal $B_{LAT}$ is generated, at the timing of the change. This enables the ink amount of ink droplets ejected from the nozzles corresponding to new bit data.

Now, description will be given of the control of the ejection amount for the joint in the print head H in accordance with the present embodiment, in accordance with a control procedure.

First, the head inclination detecting section 811, shown in FIG. 6, measures the inclination of each chip using the method described with reference to FIGS. 17 and 18. On the basis of the degree (angle) of the measured inclination, the CPU 801 varies the ejection amounts of the nozzles b1 and b2 as well as c1 and c2, forming the intervals B and C, respectively. If the print head is inclined so as to be high on the right as shown in FIG. 3, then as shown in the above calculation, the interval B between the nozzles b1 and b2 in the S direction is greater than the inter-nozzle distance R depending on the degree (angle) of the inclination. Consequently, white stripes may occur in an area printed by the nozzles b1 and b2, having the nozzle interval B, and nozzles combined in the same manner as that in which the nozzles b1 and b2 are combined. The CPU 801 thus controllably increases the ejection amount of the nozzles having the nozzle interval B. That is, the CPU 801 sends bit data to the driving circuit such that a wider pre-pulse is selected from those shown in FIGS. 9F to 9I.

On the other hand, the interval C between the nozzles c1 and c2 in the S direction is smaller than the inter-nozzle distance R. Therefore, an area printed by the nozzles c1 and c2, having the nozzle interval C, and nozzles combined in the same manner as that in which the nozzles c1 and c2 are combined may occur black stripes. Thus, as opposed to the above case, the CPU 801 controllably reduces the ejection amount of the nozzles having the nozzle interval C. In either case, experiments and examinations are performed to predetermine by what amount the ejection amount is to be increased or reduced depending on the inclination of the print head, that is, an increase or decrease in nozzle interval. The data obtained is stored in the "ejection amount correction data RAM" 810 in FIG. 8 so that the driving pulses for the nozzles having the nozzle intervals B and C are determined on the basis of the measured inclinations. This enables the ejection amount to be appropriately controlled in accordance with the inclination of the print head, allowing a reduction in the occurrence of white or black stripes in print images. Alternatively, the occurrence of a white or black stripe in a printed image can be reduced by controlling the ejection amounts of all the nozzles in the joint.

The present embodiment uses the 2-bit selection bit data to select one of the four pre-pulses. Increasing the number of bits in the selection bit data enables the ejection amount to be more precisely controlled. However, this complicates the configuration of the circuit and increases costs. Therefore the variable range of the required ejection amount is determined by previously examining to what degree the inclination of the print head can be reduced on the basis of the specification (for example, mechanical measures) of the whole apparatus.

Furthermore, in the first embodiment, with the voltage of the driving pulse fixed, and the pulse width is switched to vary the ejection amount. However, similar effects can be exerted by varying the voltage of the pulse with the pulse width of the driving pulse fixed. Moreover, control can be performed by varying both the pulse width and voltage of the driving pulse. This enables more precise control.

(Second Embodiment)

Now, a second embodiment of the present invention will be described.

The first embodiment controls the amount (ejection amount) of ink droplets ejected from the nozzles positioned in each of the joints in the print head H. In contrast, the second embodiment reduces the occurrence of white and black stripes in an area printed by the nozzles positioned in the joint by controlling the number of ink droplets ejected from the joint in accordance with the inclination of the print head H. An ink jet printing apparatus in accordance with the second embodiment is of a full-line type using what is called a joint head composed of a plurality of combined chips and having a configuration shown in FIGS. 4 to 10 as is the case with the first embodiment.

Figure 11:
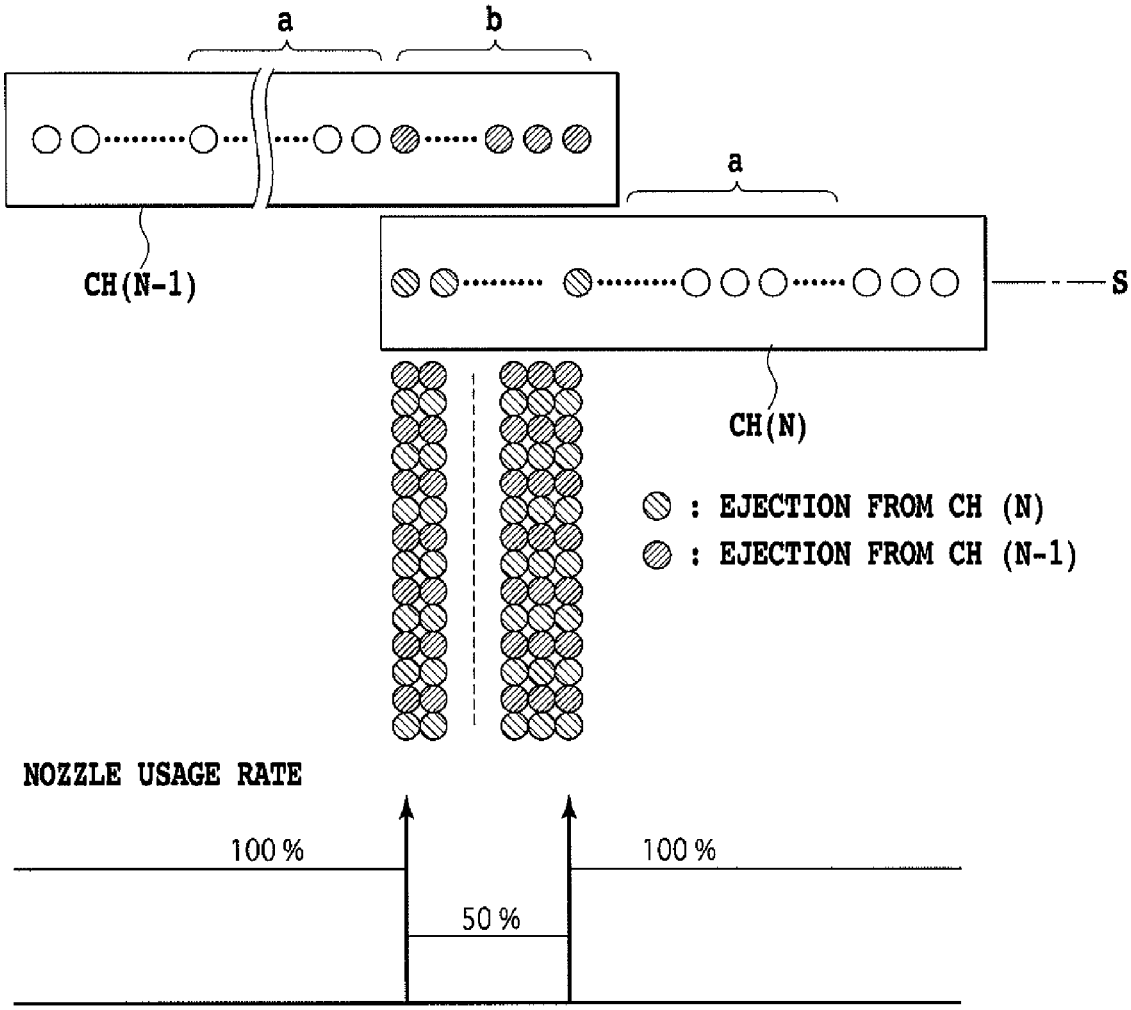
FIG. 11 is a diagram illustrating a joint between chips CH (N−1) and CN (N) in a print head in accordance with a second embodiment as well as the usage rate of nozzles positioned in the joint, wherein the print head is located in a regular position.

In the print head H used in the second embodiment, joined ends overlap each other as is the case with the first embodiment. FIG. 11 shows the arrangement of dots formed by the nozzles positioned in that area (joint) b of the print head H in accordance with the second embodiment in which the chips CH1 and CH2 overlap.

FIG. 11 shows that the print head H is appropriately located, that is, the print head H is not inclined. In this case, as shown in the figure, those parts of the chips CH1 and CH2 which are positioned in the joint b are each responsible for printing at a nozzle usage rate of 50%. In this case, the chips CH1 and CH2 alternately eject ink to provide an amount of ink required for forming an image (100%).

On the other hand, in a non-joint portion a of each of the chips CH1 and CH2, only one nozzle is used to form a print image. That is, the nozzle usage rate of the non-joint portion a is 100%. The term "nozzle usage rate" as used herein means the rate at which the nozzle ejects ink for a print image for which the nozzle is responsible. In other words, the nozzle usage rate means the ratio (ejection data/print data) of print data made up of data (ejection data) instructing the nozzle to eject ink and data (non-ejection data) instructing the nozzle not to eject ink to data instructing an ink ejecting operation to be performed.

Now, description will be given of nozzle ejection control performed on the joints (overlapping portions) b between the chips CH (N−1) and CH (N) and between the chips CH (N) and CH (N+1) on the assumption that the print head H is inclined so as to be high on the right as shown in FIG. 3.

Figure 12:
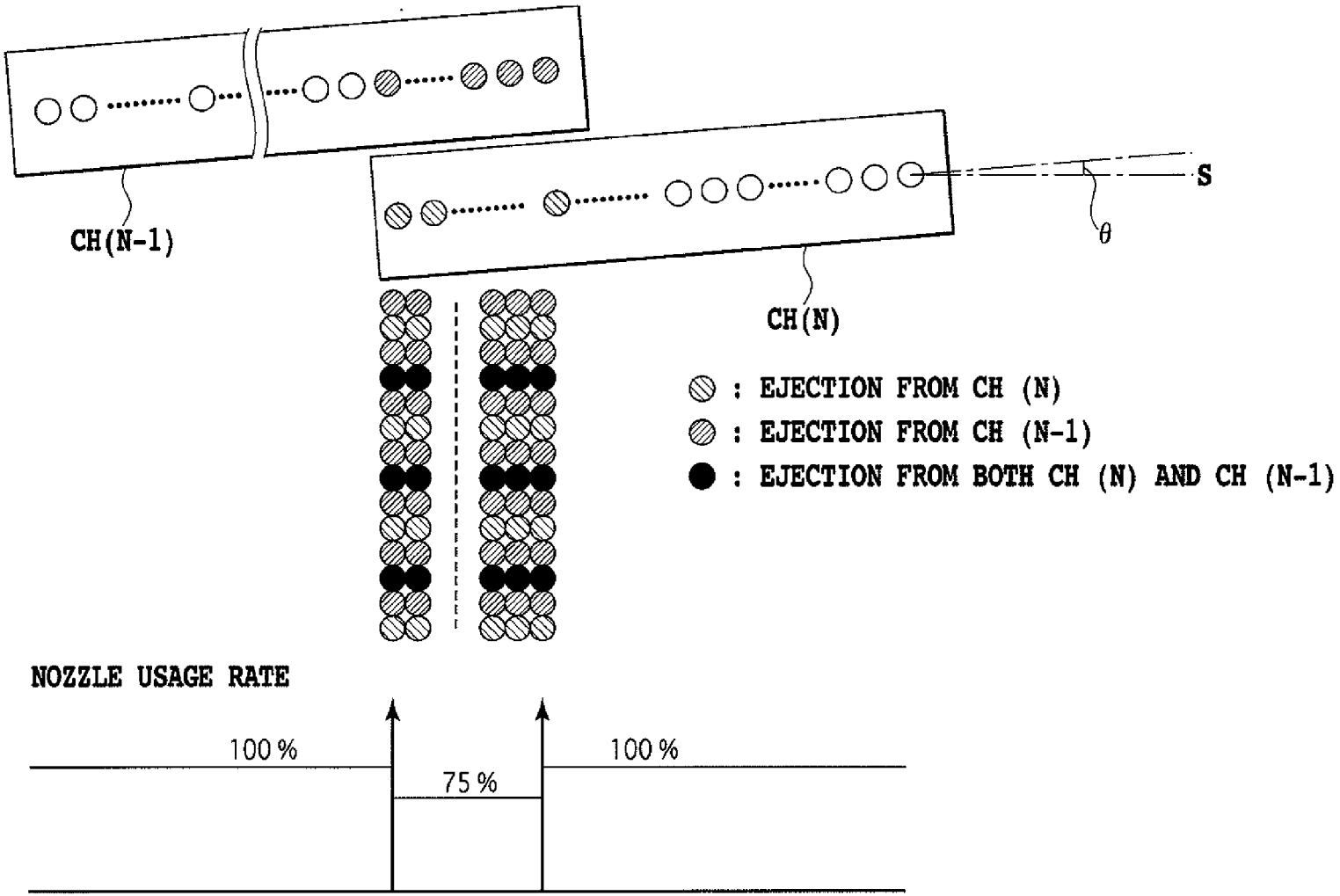
FIG. 12 is a diagram illustrating the joint between the chips CH (N−1) and CN (N) in the print head in accordance with the second embodiment as well as the usage rate of the nozzles positioned in the joint, wherein the print head is inclined to the regular position.

As already described, in the joint b between the chips CH (N−1) and CH (N), the number of nozzle combinations in which the interval between the adjacent nozzles is greater than the inter-nozzle distance R increases. As a result, white stripes may occur. Thus, control is performed such that the nozzle usage rate of the joint b is increased to increase the number of ink droplets ejected from the joint b between the chips CH (N−1) and CH (N) as shown in FIG. 12. In FIG. 12, both the chips CH(N) and CH (N−1) have a nozzle usage rate of 75% in the joint b. This corresponds to a 25% increase in nozzle usage rate in the joint b in each chip compared to the nozzle usage rate used when the print head H is not inclined. That is, the total usage rate of the nozzles positioned in the joint b in both chips is 150%. This increases the number of nozzles positioned in the nozzle b, reducing the occurrence of white stripes.

In FIG. 12, the nozzle usage rates of the chips CH (N) and CH (N−1) in the joint b are set at the same value. However, similar effects can be exerted by setting the nozzle usage rates of the chips CH (N) and CH (N−1) at different values. That is, the white stripe inhibiting effect can also be exerted by increasing the total usage rate of the chips CH (N) and CH (N−1) in the joint b. For example, the usage rate of one of the chips CH (N) and CH (N−1) may be increased or the usage rates of the nozzles positioned in the joint b in each chip may be set at different values. This enables possible white stripes to be inhibited.

Figure 13:
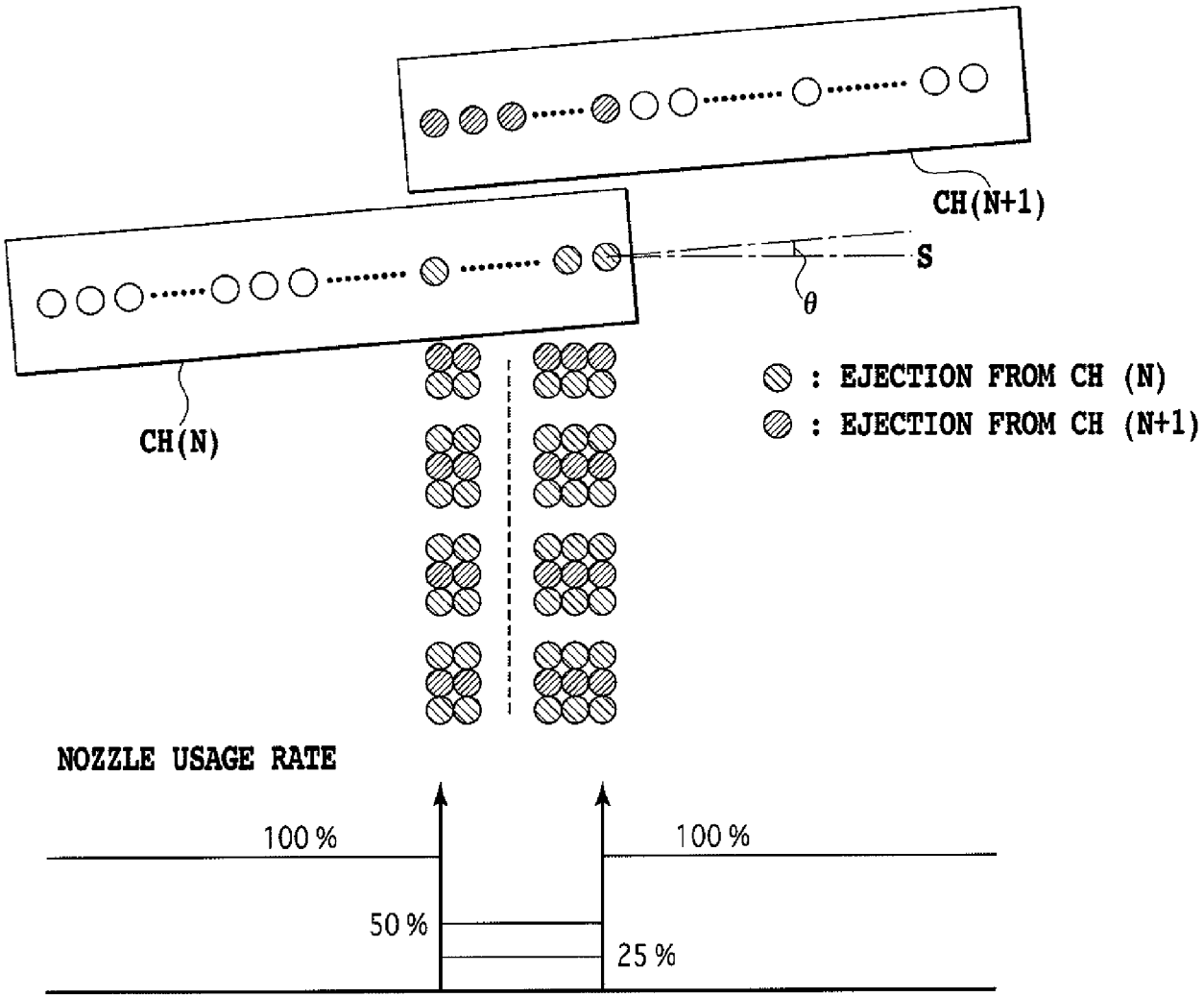
FIG. 13 is a diagram illustrating the joint between chips CH (N) and CN (N+1) in the print head in accordance with the second embodiment as well as the usage rate of the nozzles positioned in the joint, wherein the print head is inclined to the regular position.

On the other hand, in the joint b between the chips CH (N) and CH (N+1), the number of nozzle combinations in which the interval between the adjacent nozzles is smaller than the inter-nozzle distance R increases. Thus, control is performed so as to reduce the nozzle usage rate of the nozzles in the joint b between the chips CH (N) and CH (N+1). In FIG. 13, control is performed so as to set the total of the usage rates of the chips CH (N) and CH (N+1) at 75%. That is, the total of the usage rates of the nozzles in the joint b in the chips is reduced by 25% compared to the total of the usage rates of the chips in the joint b used when the print head H is not inclined. In this case, the total of the usage rates of both chips in the joint b can be reduced in various combinatory manners. For example, the nozzle usage rates of both chips may be reduced or the nozzle usage rate of only one of the chips may be reduced. In FIG. 13, one of the chips CH (N) and CH (N+1) is set at a usage rate of 25%. Possible black stripes can be inhibited by thus reducing the total of the nozzle usage rates of both chips CH (N) and CH (N+1) compared to the nozzle usage rates used when the print head H is not inclined.

The above-described ink droplet ejection control is performed by first detecting the inclination of the print head H, and based on the result of the detection, changing the nozzle usage rate for the joint b and thus the number of ink droplets ejected from the nozzles, as is the case with the first embodiment. More specifically, on the basis of the inclination of the print head H, the CPU 801, shown in FIG. 6, reads correction data from the ejection control data RAM 810. On the basis of the correction data, a correction process is executed on initial print data obtained when the print head H is not inclined. That is, a correction process of increasing or reducing the number of ejected ink droplets is executed on that part of the initial print data supplied to each of the chips which corresponds to the joint. Experiments may be conducted to pre-obtain data on the basic characteristics of the print head H relating to the inclination and nozzle usage rate thereof, that is, ejection control data indicating by what amount the nozzle usage rate is to be changed in accordance with the inclination of the print head H. The data obtained is stored in the ejection control data RAM 810 to allow the above-described ejection control to be performed.

(Third Embodiment)

Figure 14:
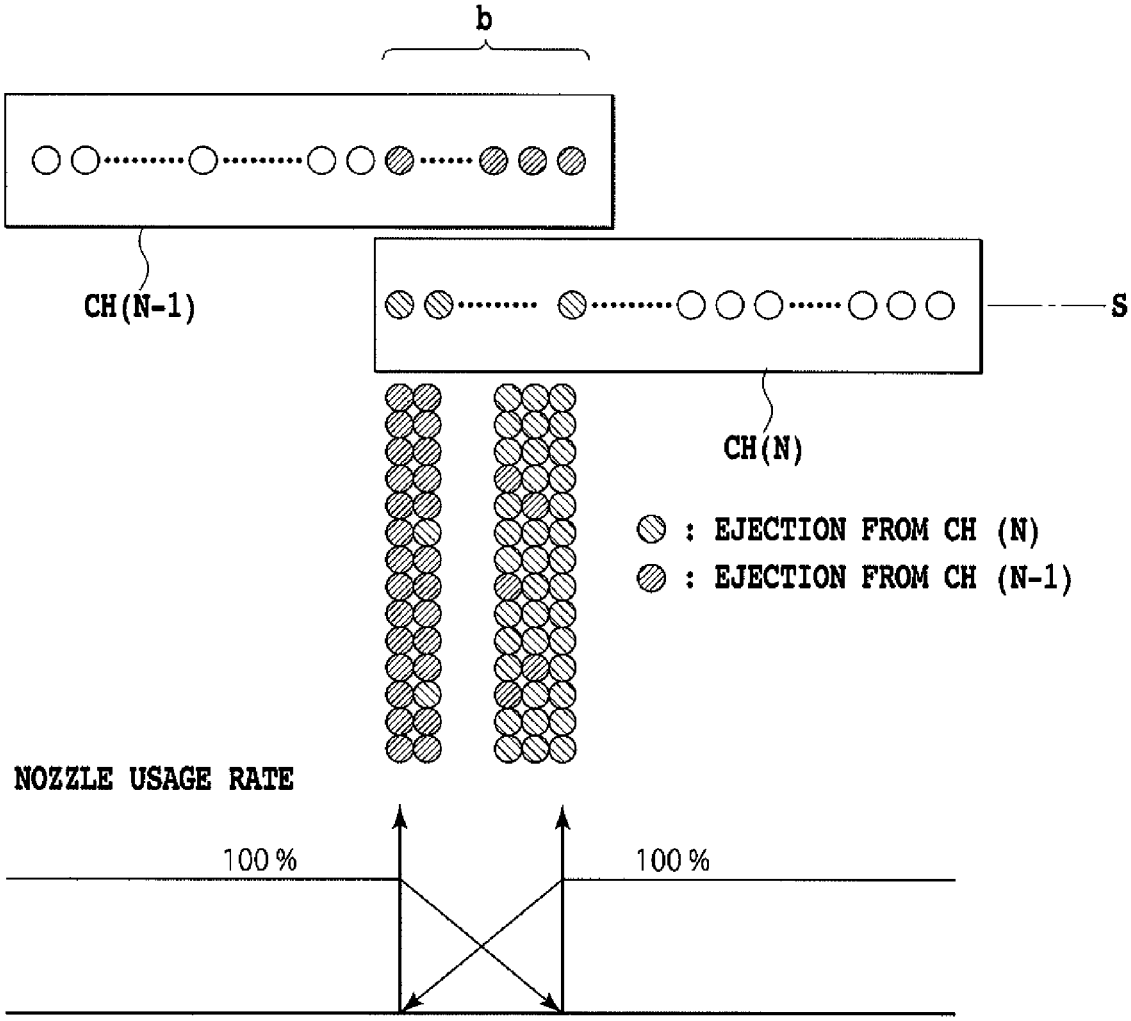
FIG. 14 is a diagram illustrating a joint between chips CH (N) and CN (N+1) in a print head in accordance with a third embodiment as well as the usage rate of nozzles positioned in the joint.

In the description of the second embodiment, control is performed such that the nozzle usage rate of the nozzles positioned in each joint is uniform within the same chip by way of example. In contrast, a third embodiment of the present invention not only performs the ejection control of the joint against the inclination of the print head but also performs control such that the usage rate of the nozzles in the joint in each chip decreases consistently with the distance between the nozzles and the end of the chip as shown in FIG. 14.

In general, in the ink jet print head, the nozzles located closer to the end of the chip tend to exhibit lower ejection performance (ejection direction or amount). Thus, performing control such that the ink ejection rate is reduced for the nozzles located closer to the end of the chip is conventionally known to be effective for inhibiting possible density unevenness (for example, black and white stripes) at the joint.

Thus, in the third embodiment, in performing control such that the ink ejection rate is reduced for the nozzles located closer to the end of the chip, the usage rate of the nozzles positioned in the joint in each chip is corrected on the basis of the inclination of the print head H as is the case with the second embodiment. Of course, in this case, since the print data used when the print head H is located in the regular position is different from that in the second embodiment, the correction data on the nozzle usage rate, which is to be varied depending on the inclination of the print head, needs to be set at values different from those in the second embodiment. Thus, also in the third embodiment, experiments or pre-examinations are performed to determine the appropriate correction amount for the number of ink ejections in association with the inclination of the print head. The data corresponding to the correction amount is stored in the ejection correction data RAM in FIG. 6. This enables the conventional end control to be combined with the control of the number of ejected ink droplets against the inclination of the print head in accordance with the present invention. Possible density unevenness can thus be more effectively inhibited.

(Fourth Embodiment)

Figure 15:
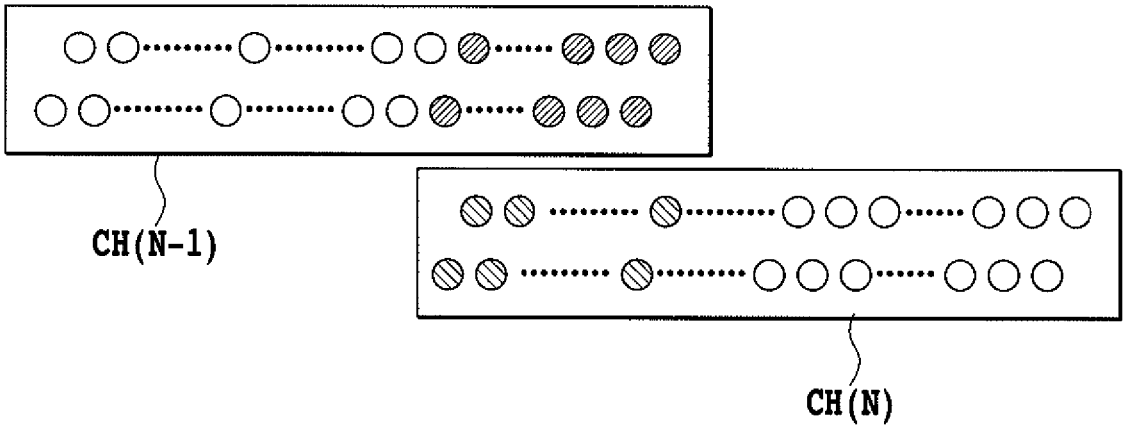
FIG. 15 is a diagram showing an example of the configuration of nozzle chips in a print head used in a fourth embodiment of the present invention.

In the above description of the embodiments, one nozzle array is provided in each of the chips provided in the print head H by way of example. However, the present invention is applicable to an ink jet printing apparatus that performs a printing operation using a print head constructed by joining a plurality of chips each having a plurality of nozzle arrays. A print head H1 shown in FIG. 15 has a plurality of nozzles staggered in each of the chips CH (N−1) and CH (N) so as to form two nozzle arrays. The print head H1 can thus form dense dots.

If the print head constructed by thus joining the chips each having the plurality of nozzle arrays is inclined to the regular position thereof, stripe-like density unevenness such as white or black stripes may also occur in the joint in each chip. Therefore, the present invention is effective on this print head. In this case, it is essential that a plurality of nozzles overlap in the joint.

(Fifth Embodiment)

In the above description of the embodiments, the print head is used in which the nozzles positioned near the end of one of the chips overlap the nozzles positioned near the end of the other chip, by way of example. However, the present invention is also applicable to an ink jet printing apparatus using a print head in which the end nozzles in one of the chips do not overlap the end nozzles in the other chip.

Figure 16:
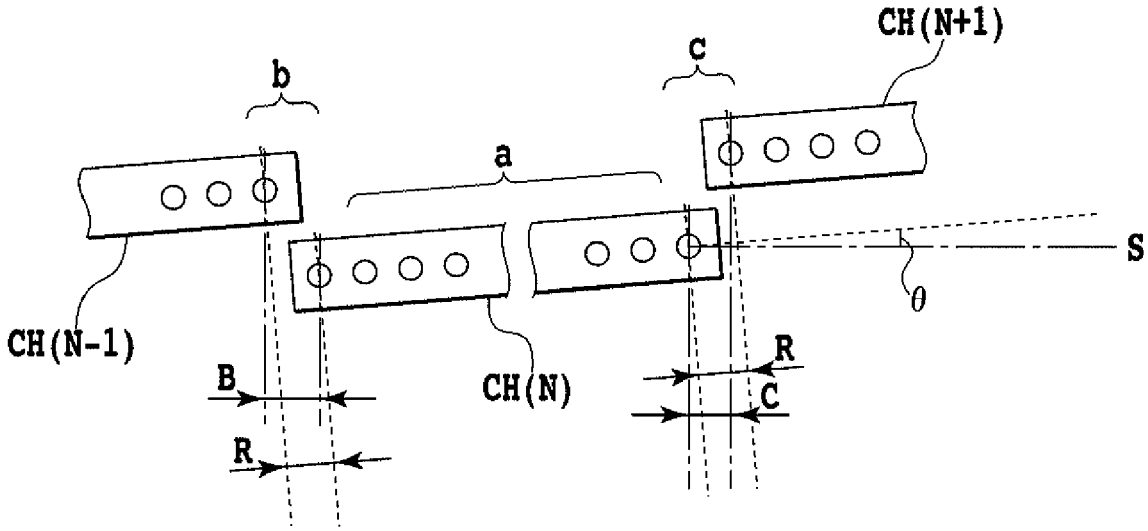
FIG. 16 is a diagram illustrating joints in a print head used in a fifth embodiment of the present invention and the interval between adjacent nozzles in each of the joints, wherein the print head is inclined to the regular position thereof.

FIG. 16 shows that a print head H2 is located so as to be high on the right, that is, inclined at an angle θ to the direction (reference direction) S orthogonal to the direction in which the print head H performs a scan operation relative to the print medium (with a full line head, the direction in which the print medium is conveyed). In this case, in each of the joints b of the print head H2, the number of combinations of nozzles having the adjacent nozzle interval B increases. In the joint c, the number of combinations of nozzles having the adjacent nozzle interval C increases. Thus, unless the print data is corrected, white stripes may occur in the joint b, while black stripes may occur in the joint c. To avoid this, control is performed so as to increase the usage rate of the nozzles positioned in the joint b in the print head H2, while reducing the usage rate of the nozzles positioned in the joint c in the print head H2. This enables a reduction in the occurrence of striped-like density unevenness at the joints b and c. However, since the nozzles in the joint in one of the chips of the print head H2 do not overlap the nozzles in the joint in the other chip, the density unevenness inhibiting effect may not be exerted under specific conditions. That is, if an image is printed at a very high printing rate (printing duty) of, for example, 100%, it is impossible to print the image at a printing rate exceeding 100% using one nozzle that does not overlap any other nozzle. Thus, if white stripes occur, the printing rate, at which the image is formed, cannot further be increased, possibly preventing sufficient corrections. However, the control in accordance with the present embodiment is effective unless an image is formed at an extreme printing rate as described above. Furthermore, even if an image is formed at a high printing rate, it is possible to reduce the occurrence of density unevenness (white stripes) at the high printing rate by performing a combination of several types of ejection amount control as in the case of the first embodiment.

(Other Embodiments)

In the above-described embodiments, the print head inclination detecting section 801 is provided in the ink jet printing apparatus. However, the inclination of the print head may be measured, for example, before shipment from a factory, and correction data based on the measurement may be stored in the RAM 810. This eliminates the need to mount hardware for detecting the inclination of the print head, on the ink jet printing apparatus. This in turn makes it possible to avoid increasing apparatus costs. However, in this case, the inclination of the print head needs to be prevented from varying over time, or even if the inclination varies, the variation needs to fall within an allowable range.

Therefore, in the most desirable form, the head inclination detecting section 811 is provided, and the inclination data on the print head measured before shipment from the factory is held in the RAM. That is, in the desirable form, initially, on the basis of the inclination data measured before shipment from the factory, any of the correction data in the RAM is selected to determine the correction amount for the joint. Subsequently, the inclination of the head is periodically measured to change the correction amount data in the RAM as required.

Furthermore, the present invention is not limited to the full line ink jet printing apparatus but is applicable to a serial ink jet printing apparatus that performs a main scanning operation of moving the print head in the direction orthogonal to the print medium conveying direction and an operation of conveying the print medium (a sub-scanning operation). That is, a serial ink jet printing apparatus may use a print head composed of a plurality of short chips joined together and may perform a printing operation by moving the print head in a main scanning direction. In this case, effects similar to those of the above-described embodiments are expected to be produced even if the print head is tilted in the direction orthogonal to the main scanning direction (the direction in which the print head H performs a scan operation relative to the print medium), in which the print head is moved. The present invention is also applicable to an ink jet printing apparatus that moves the print head with the print medium fixed in order to move the print medium and the print head relative to each other.

The embodiments have been described taking, as an example, the use of what is called a joint head having an increased length as a result of the arrangement in which chips are sequentially joined together. However, the present invention is applicable to a print head that is not composed of a plurality of chips. For example, the present invention is expected to exert similar effects on a print head composed of one chip but having nozzle arrays each including a plurality of nozzles and arranged so as to be sequentially joined together.

Figure 21:
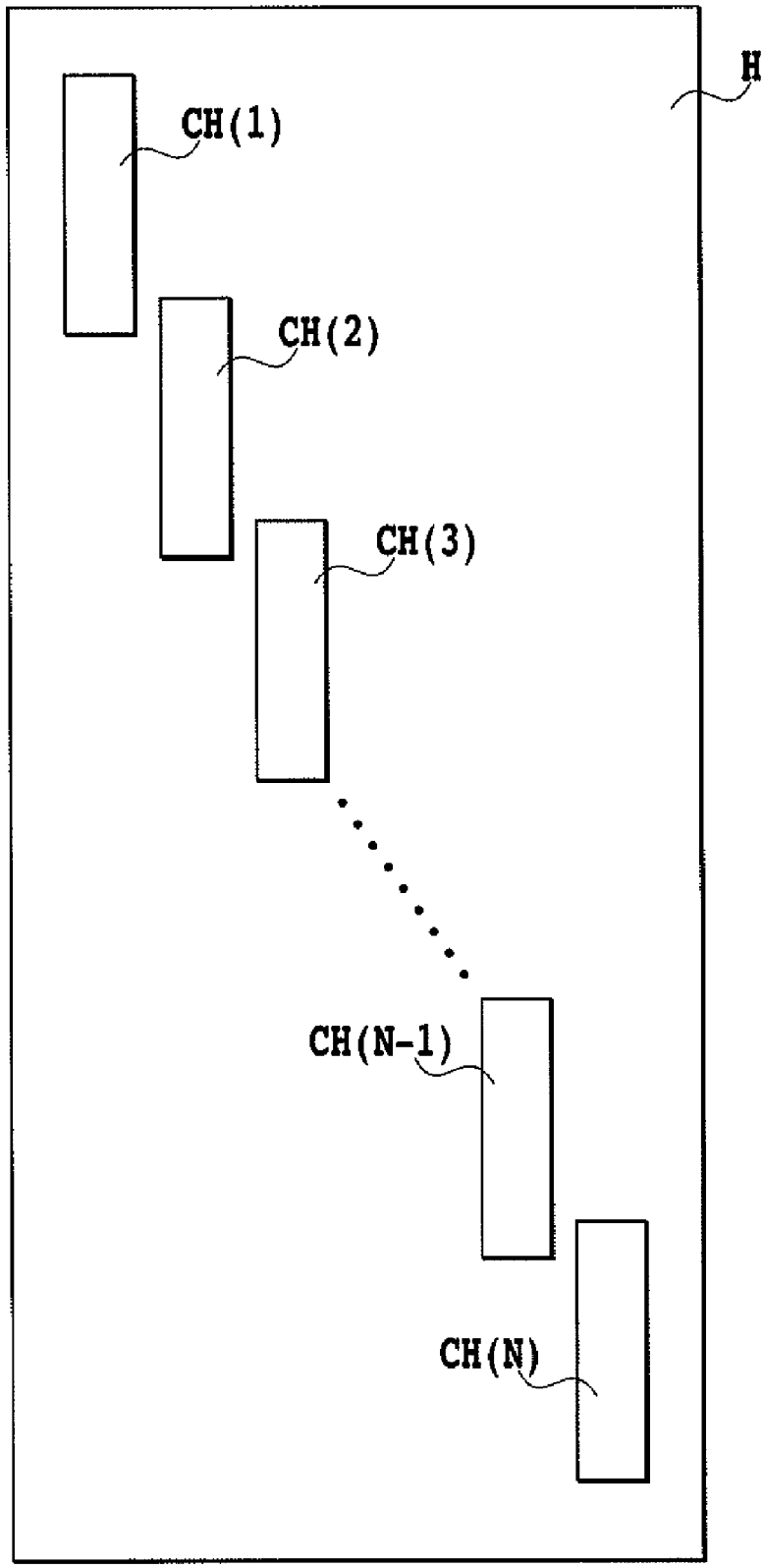
FIG. 21 is a diagram schematically showing a print head having chips arranged like steps.

Furthermore, the arrangement of the chips in the print head is not limited to the staggered one. A configuration may also be used in which the chips are arranged like steps as shown in FIG. 21. In this case, a tilt of the print head results in one of a black stripe and a white stripe in all the joints.

The above-described embodiments use the print head that uses heat energy from the electrothermal conversion elements provided in the nozzles to eject the ink from the ejection orifices. However, the present invention is applicable to a print head using ejection energy generating elements other than the electrothermal conversion elements. For example, the present invention is applicable to a print head using electromechanical conversion elements such as piezoelectric elements as ejection energy generating elements.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-033650, filed Feb. 14, 2007, which is hereby incorporated by reference herein in its entirety.

What is claimed is:

1. An ink jet printing apparatus comprising:

a print head provided with a plurality of chips, each chip includes a nozzle member provided with a plurality of nozzles for ejecting ink, the plurality of chips are arranged so as to be shifted in a direction in which the plurality of nozzles are arranged, and such that an area where a plurality of nozzles of a first nozzle member included in a first chip and an area where a plurality of nozzles of a second nozzle member included in a second chip overlap one another in a direction crossing the nozzle arranging direction;

a moving unit configured to move the print head relative to a print medium;

a printing unit configured to print an image on the print medium by causing the print head to eject the ink while the print head moves relative to the print medium;

a detection unit that detects an inclination of the print head in a direction orthogonal to a direction in which the print head moves relative to the print medium; and a controller that controls an ink ejecting operation of the plurality of nozzles in the overlapping portions of the first chip and the second chip on the basis of the inclination of the print head in the direction orthogonal to the direction in which the print head moves relative to the print medium detected by the detection unit.

2. The ink jet printing apparatus according to claim 1, wherein the plurality of chips are staggered along the nozzle arranging direction.

3. The ink jet printing apparatus according to claim 1, wherein for chips which are adjacent to each other in the nozzle arranging direction, positions of nozzles in an overlapping portion of one of the adjacent chips are equal to positions of nozzles in an overlapping portion of the other adjacent chip, in the nozzle arranging direction.

4. The ink jet printing apparatus according to claim 1, wherein at least one of the plurality of chips has different overlapping portions, and the controller performs different ejection control operations on the different overlapping portions.

5. The ink jet printing apparatus according to claim 1, wherein the control means controls the number of ink ejections from the nozzles positioned in the overlapping portions.

6. The ink jet printing apparatus according to claim 1, wherein the controller controls the amount of ink ejected from the plurality of nozzles positioned in the overlapping portions of the first chip and the second chip, during each ejecting operation.

7. The ink jet printing apparatus according to claim 6, wherein the controller controls at least one of a voltage of and an application time for an electric signal applied to an electrothermal conversion element provided in each of the nozzles of the plurality of chips.

8. The ink jet printing apparatus according to claim 1, further comprising a pattern formation unit that uses the print head to form a first straight line formed by the first chip so as to extend in the nozzle arranging direction, and a second straight line formed by the second chip so as to extend in the nozzle arranging direction, wherein the detection unit detects the inclination of the print head on the basis of the amount by which the first straight line and the second straight line are shifted in the relative movement direction.

* * * * *